US006552702B1

(12) United States Patent
Abe et al.

(10) Patent No.: US 6,552,702 B1
(45) Date of Patent: Apr. 22, 2003

(54) IMAGE DISPLAY APPARATUS AND DISPLAY CONTROL METHOD

(75) Inventors: Naoto Abe, Yokohama (JP); Tatsuro Yamazaki, Machida (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/512,640

(22) Filed: Feb. 24, 2000

(30) Foreign Application Priority Data

Feb. 26, 1999 (JP) ..... 11-052049
Feb. 26, 1999 (JP) ..... 11-052053
Jan. 28, 2000 (JP) ..... 2000-020759

(51) Int. Cl.[7] ..... G09G 3/22

(52) U.S. Cl. ..... 345/75.2; 345/76; 345/77; 345/78; 345/74.1; 345/74.2; 345/75.2; 345/98; 345/100

(58) Field of Search ..... 345/76, 77, 78, 345/74.1, 75.1, 75.2, 98, 100

(56) References Cited

U.S. PATENT DOCUMENTS

| | | | | |
|---|---|---|---|---|
| 4,904,895 A | | 2/1990 | Tsukamoto et al. | 313/336 |
| 5,066,883 A | | 11/1991 | Yoshioka et al. | 313/309 |
| 5,569,974 A | | 10/1996 | Morikawa et al. | 313/310 |
| 5,682,085 A | | 10/1997 | Suzuki et al. | 315/169.1 |
| 6,140,985 A | * | 10/2000 | Kanai et al. | 345/74 |
| 6,184,850 B1 | * | 2/2001 | Suzuki et al. | 345/74 |
| 6,195,076 B1 | * | 2/2001 | Sakuragi et al. | 345/74 |

FOREIGN PATENT DOCUMENTS

| | | |
|---|---|---|
| JP | 64-31332 | 1/1989 |
| JP | 2-257551 | 10/1990 |
| JP | 3-55738 | 3/1991 |
| JP | 4-28137 | 1/1992 |

OTHER PUBLICATIONS

H. Araki, et al., "Electroforming and Electron Emission of Carbon Thin Films", vol. 26, No. 1, pp. 22–29 (1983).

M.I. Elinson, et al., "The Emission of Hot Electrons and the Field Emission of Electrons From Tin Oxide", Radio Engineering Electron Physics, 10, pp. 1290–1296 (Jul. 1965).

M. Hartwell, et al., "Strong Electron Emission From Patterned Tin–Indium Oxide Thin Films", International Electron Devices Meeting, pp. 519–521 (1975).

G. Dittmer, "Electrical Conduction and Electron Emission of Discontinuous Thin Films", Thin Solid Films, No. 9, pp. 317–328 (1972).

(List continued on next page.)

*Primary Examiner*—Richard Hjerpe
*Assistant Examiner*—Jennifer T. Nguyen
(74) *Attorney, Agent, or Firm*—Fitzpatrick, Cella, Harper & Scinto

(57) ABSTRACT

An image display apparatus performs color adjustment such that the emission luminances of emission substances of respective colors that emit light upon reception of electrons emitted by electron-emitting devices are controlled by controlling the electron amount emitted by the electron-emitting devices. A pulse width-modulated signal corresponding to an image signal is input to the column wiring of a display panel having an electron source with a plurality of electron-emitting devices and fluorescent substances laid out in stripes in correspondence with the respective colors. A horizontal scanning signal for driving a row wiring is input to the row wiring in synchronism with image display. The pulse width-modulated signal is driven by voltages from different power sources in units of the respective colors. The output voltages of the power sources are changed to control the driving voltages of the electron-emitting devices for irradiating fluorescent substances corresponding to the respective colors with electrons.

31 Claims, 27 Drawing Sheets

OTHER PUBLICATIONS

W.P. Dyke, et al., "Field Emission", Advances in Electronics and Electron Physics, vol. VIII, pp. 89–185 (1956).

C.A. Mead, "Operation of Tunnel–Emission Devices", Journal of Applied Physics, vol. 32, No. 4, pp. 646–652 (Apr. 1961).

R. Meyer, "Recent Development on "Microtips" Display at LETI", Technical Digest of IVMC 91, pp. 6–9 (1991).

C.A. Spindt, et al., "Physical Properties of Thin–Film Field Emission Cathodes with Molybdenum Cones", Journal of Applied Physics, vol. 47, No. 12, pp. 5248–5263 (Dec. 1976).

* cited by examiner

R : RED FLUORESCENT SUBSTANCE
G : GREEN FLUORESCENT SUBSTANCE
B : BLUE FLUORESCENT SUBSTANCE

R : RED FLUORESCENT SUBSTANCE
G : GREEN FLUORESCENT SUBSTANCE
B : BLUE FLUORESCENT SUBSTANCE

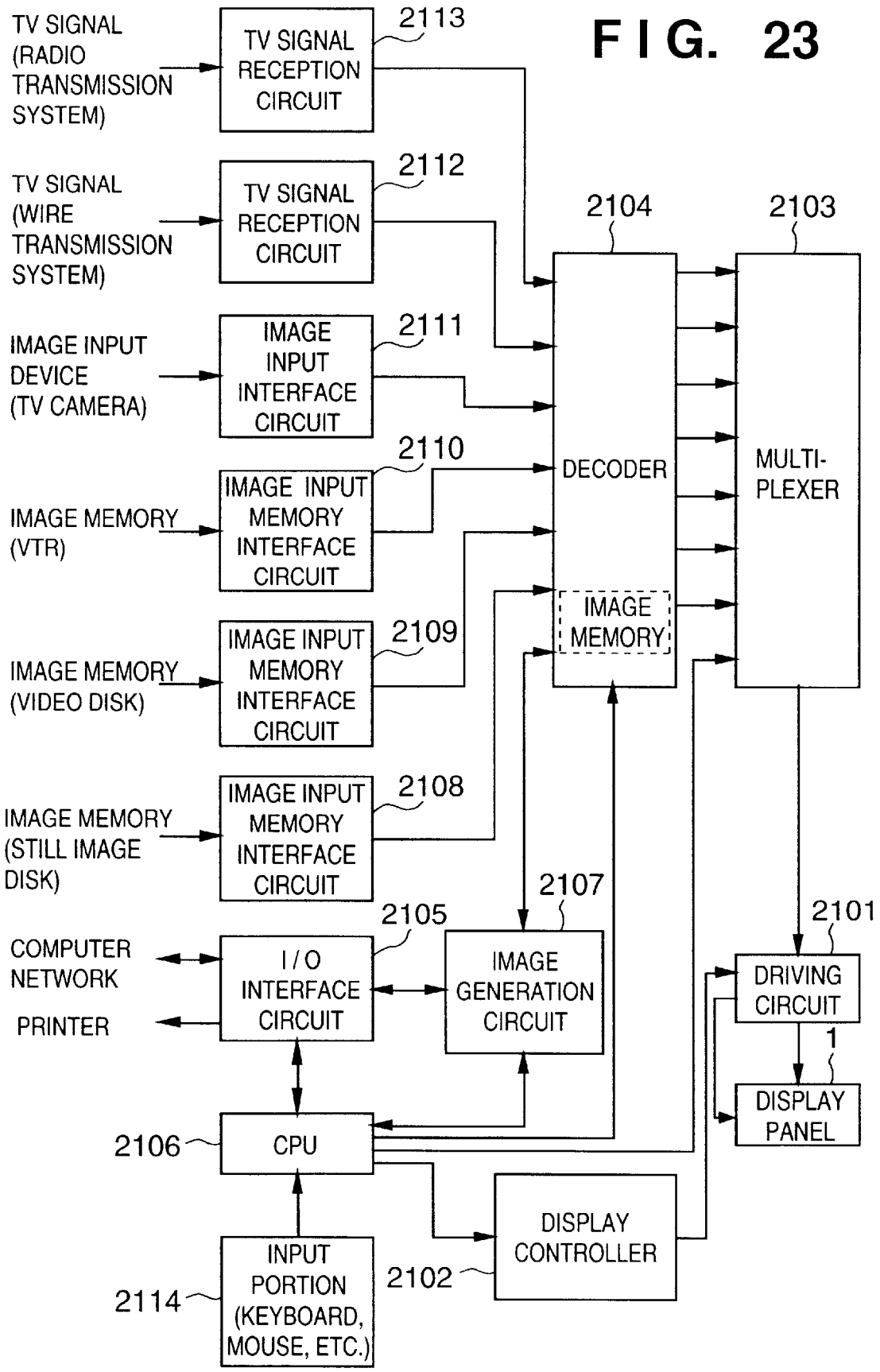
FIG. 23
TV SIGNAL (RADIO TRANSMISSION SYSTEM)
TV SIGNAL RECEPTION CIRCUIT
2113
TV SIGNAL (WIRE TRANSMISSION SYSTEM)
TV SIGNAL RECEPTION CIRCUIT
2112
IMAGE INPUT DEVICE (TV CAMERA)
IMAGE INPUT INTERFACE CIRCUIT
2111
IMAGE MEMORY (VTR)
IMAGE INPUT MEMORY INTERFACE CIRCUIT
2110
IMAGE MEMORY (VIDEO DISK)
IMAGE INPUT MEMORY INTERFACE CIRCUIT
2109
IMAGE MEMORY (STILL IMAGE DISK)
IMAGE INPUT MEMORY INTERFACE CIRCUIT
2108
2104
DECODER
IMAGE MEMORY
2103
MULTI-PLEXER
2107
IMAGE GENERATION CIRCUIT
2105
COMPUTER NETWORK
PRINTER
I/O INTERFACE CIRCUIT
2101
DRIVING CIRCUIT
1
DISPLAY PANEL
2106
CPU
DISPLAY CONTROLLER
2102
2114
INPUT PORTION (KEYBOARD, MOUSE, ETC.)

IMAGE DISPLAY APPARATUS AND DISPLAY CONTROL METHOD

FIELD OF THE INVENTION

The present invention relates to an image display apparatus for displaying an image in accordance with a television image signal or the like and a driving method thereof and, more particularly, to an image display apparatus having an electron source with a plurality of electron-emitting devices and a fluorescent substance for emitting light upon reception of electrons emitted by the electron source, and a display control method in the apparatus.

BACKGROUND OF THE INVENTION

Conventionally, two types of devices, namely thermionic and cold cathode devices, are known as electron-emitting devices. Known examples of the cold cathode devices are surface-conduction emission type electron-emitting devices, field emission type electron-emitting devices (to be referred to as FE type electron-emitting devices hereinafter), and metal/insulator/metal type electron-emitting devices (to be referred to as MIM type electron-emitting devices hereinafter).

A known example of the surface-conduction emission type electron-emitting devices is described in, e.g., M. I. Elinson, "Radio E-ng. Electron Phys., 10, 1290 (1965) and other examples will be described later. The surface-conduction emission type electron-emitting device utilizes the phenomenon that electrons are emitted by a small-area thin film formed on a substrate by flowing a current parallel through the film surface. The surface-conduction emission type electron-emitting device includes electron-emitting devices using an Au thin film [G. Dittmer, "Thin Solid Films", 9, 317 (1972)], an $In_2O_3/SnO_2$ thin film [M. Hartwell and C. G. Fonstad, "IEEE Trans. ED Conf.", 519 (1975)], a carbon thin film [Hisashi Araki et al., "Vacuum", Vol. 26, No. 1, p. 22 (1983)], and the like, in addition to an $SnO_2$ thin film according to Elinson mentioned above.

FIG. 24 is a plan view showing the device by M. Hartwell et al. described above as a typical example of the device structures of these surface-conduction emission type electron-emitting devices. Referring to FIG. 24, reference numeral 3001 denotes a substrate; and 3004, a conductive thin film made of a metal oxide formed by sputtering. This conductive thin film 3004 has an H-shaped pattern, as shown in FIG. 24. An electron-emitting portion 3005 is formed by performing electrification processing (referred to as forming processing to be described later) with respect to the conductive thin film 3004. An interval L in FIG. 24 is set to 0.5 to 1 mm, and a width W is set to 0.1 mm. The electron-emitting portion 3005 is shown in a rectangular shape at the center of the conductive thin film 3004 for the sake of illustrative convenience. However, this does not exactly show the actual position and shape of the electron-emitting portion.

In the above surface-conduction emission type electron-emitting devices by M. Hartwell et al. and the like, typically the electron-emitting portion 3005 is formed by performing electrification processing called forming processing for the conductive thin film 3004 before electron emission. In forming processing, a constant DC voltage or a DC voltage which increases at a very low rate of, e.g., 1 V/min is applied across the conductive thin film 3004 to partially destroy or deform the conductive thin film 3004, thereby forming the electron-emitting portion 3005 with an electrically high resistance. Note that the destroyed or deformed part of the conductive thin film 3004 has a fissure. Upon application of an appropriate voltage to the conductive thin film 3004 after forming processing, electrons are emitted near the fissure.

Known examples of the FE type electron-emitting devices are described in W. P. Dyke and W. W. Dolan, "Field emission", Advance in Electron Physics, 8, 89 (1956) and C. A. Spindt, "Physical properties of thin-film field emission cathodes with molybdenium cones", J. Appl. Phys., 47, 5248 (1976).

FIG. 25 is a sectional view showing the device by C. A. Spindt et al. described above as a typical example of the FE type device structure. In FIG. 25, reference numeral 3010 denotes a substrate; 3011, an emitter wiring made of a conductive material; 3012, an emitter cone; 3013, an insulating layer; and 3014, a gate electrode. In the FE type device, a voltage is applied between the emitter cone 3012 and gate electrode 3014 to emit electrons from the distal end portion of the emitter cone 3012.

As another FE type device structure, there is an example in which an emitter and gate electrode are arranged on a substrate to be almost parallel to the surface of the substrate, in addition to the multilayered structure of FIG. 25.

A known example of the MIM type electron-emitting devices is described in C. A. Mead, "Operation of Tunnel-Emission Devices", J. Appl. Phys., 32,646 (1961). FIG. 26 shows a typical example of the MIM type device structure. In FIG. 26, reference numeral 3020 denotes a substrate; 3021, a lower electrode made of a metal; 3022, a thin insulating layer having a thickness of about 100 Å; and 3023, an upper electrode made of a metal and having a thickness of about 80 to 300 Å. In the MIM type electron-emitting device, an appropriate voltage is applied between the upper and lower electrodes 3023 and 3021 to emit electrons from the surface of the upper electrode 3023.

Since the above-described cold cathode devices can emit electrons at a temperature lower than that for thermionic cathodes, they do not require any heater. The cold cathode device has a structure simpler than that of the thermionic cathode and can shrink in feature size. Even if a large number of devices are arranged on a substrate at a high density, problems such as heat fusion of the substrate hardly arise. In addition, the response speed of the cold cathode device is high, while the response speed of the thermionic cathode is low because thermionic cathode operates upon heating by a heater.

For this reason, applications of the cold cathode devices have enthusiastically been studied.

Of cold cathode devices, the surface-conduction emission type electron-emitting devices have a simple structure and can be easily manufactured, and thus many devices can be formed on a wide area. As disclosed in Japanese Patent Laid-Open No. 64-31332 filed by the present applicant, a method of arranging and driving a lot of devices has been studied.

Regarding applications of the surface-conduction emission type electron-emitting devices to, e.g., image forming apparatuses such as an image display apparatus and image recording apparatus, charge beam sources, and the like have been studied.

Particularly as an application to image display apparatuses, as disclosed in the U.S. Pat. No. 5,066,883 and Japanese Patent Laid-Open Nos. 2-257551 and 4-28137 filed by the present applicant, an image display apparatus using a combination of a surface-conduction emission type electron-emitting device and a fluorescent substance which emits light upon irradiation of an electron beam has been studied. This type of image display apparatus using a combination of the surface-conduction emission type electron-emitting device and fluorescent substance is expected to exhibit more excellent characteristics than other conventional image display apparatuses. For example, compared with recent popular liquid crystal display apparatuses, the above display apparatus is superior in that it does not require any backlight because it is of a self-emission type and that it has a wide view angle.

A method of driving a plurality of FE type electron-emitting devices arranged side by side is disclosed in, e.g., U.S. Pat. No. 4,904,895 filed by the present applicant. As a known example of an application of FE type electron-emitting devices to an image display apparatus is a flat panel display reported by R. Meyer et al. [R. Meyer: "Recent Development on Microtips Display at LETI", Tech. Digest of 4th Int. Vacuum Microelectronics Conf., Nagahama, pp. 6–9 (1991)].

An application of a larger number of MIM type electron-emitting devices arranged side by side to an image display apparatus is disclosed in Japanese Patent Laid-Open No. 3-55738 filed by the present applicant.

The present inventors have examined cold cathode devices of various materials, various manufacturing methods, and various structures, in addition to the above-mentioned cold cathode. Further, the present inventors have made extensive studies on a multi electron-beam source having a large number of cold cathode devices, and an image display apparatus using this multi electron-beam source.

The present inventors have examined a multi electron-beam source having an electrical wiring method shown in, e.g., FIG. 27. That is, a large number of cold cathode devices are two-dimensionally arranged in a matrix to obtain a multi electron-beam source, as shown in FIG. 27.

Referring to FIG. 27, numeral 4001 denotes a cold cathode; 4002, a row-direction wiring; and 4003, a column-direction wiring. The row- and column-direction wirings 4002 and 4003 actually have finite electrical resistances, which are represented as wiring resistances 4004 and 4005 in FIG. 27. This wiring method is called a simple matrix wiring method.

For the illustrative convenience, the multi electron-beam source is illustrated in a 6×6 matrix, but the size of the matrix is not limited to this. For example, in a multi electron-beam source for an image display apparatus, a number of devices enough to perform a desired image display are arranged and wired.

In a multi electron-beam source in which cold cathode devices are arranged in a simple matrix, appropriate electrical signals are applied to the row- and column-direction wirings 4002 and 4003 to output a desired electron beam. For example, to drive cold cathode devices on an arbitrary row in the matrix, a selection voltage Vs is applied to a column-direction wiring 4002 on a row to be selected, and at the same time, a non-selection voltage Vns is applied to row-direction wirings 4002 on unselected rows. In synchronism with this, a driving voltage Ve for outputting an electron beam is applied to the column-direction wirings 4003. According to this method, when voltage drops across the wiring resistances 4004 and 4005 are neglected, a voltage (Ve−Vs) is applied to the cold cathode device on the selected row, and a voltage (Ve−Vns) is applied to the cold cathode devices on the unselected rows. When the voltages Ve, Vs, and Vns are set to appropriate levels, an electron beam having a desired intensity must be output from only the cold cathode device on the selected row. When different driving voltages Ve are applied to the respective column-direction wirings, electron beams having different intensities must be output from respective cathodes on the selected row. A time for outputting an electron beam can be changed by changing a time for applying the driving voltage Ve.

A multi electron-beam source obtained by arranging cold cathode devices in a simple matrix has a variety of applications. For example, when an electrical signal corresponding to image information is appropriately applied, the multi electron-beam source can be applied as an electron source for an image display apparatus.

As described above, a desired beam output can be obtained by applying a driving voltage and performing pulse width modulation. In some cases, however, a desired beam output fails to obtain owing to the voltage drop caused by the wiring resistances 4004 and 4005. To prevent this, the electron source adopts a method of supplying a current value corresponding to the voltage (Ve−Vs) from a current source to the cold cathode. According to this method, a desired voltage can be applied to each cold cathode device regardless of the voltage drop caused by the wiring resistances 4004 and 4005.

A color display apparatus, which uses such electron source and a fluorescent substance for emitting light upon reception of electrons from the electron source, comprises fluorescent substances corresponding to, e.g., R, G, and B colors. These fluorescent substances are driven in accordance with an input image signal to display a color image corresponding to the input image signal. However, if the color tone of a color image to be displayed is changed by the user or the like, this color display apparatus cannot display a color image in colors of user tastes by simple color adjustment.

SUMMARY OF THE INVENTION

The present invention has been made in consideration of the above situation, and has as its object to provide an image display apparatus for performing color adjustment by controlling the electron-emitting amount from electron-emitting devices which drive emission substances of respective colors, and a display control method in the apparatus.

It is another object of the present invention to provide an image display apparatus which has voltage sources in correspondence with driving sources for emission substances of respective colors, and performs color adjustment by controlling the output voltage of each voltage source to control the electron-emitting amount for driving the emission substances, and a display control method in the apparatus.

It is still another object of the present invention to provide an image display apparatus which has current sources in correspondence with driving sources for emission substances of respective colors, and performs color adjustment by controlling the output current of each current source to control the electron-emitting amount for driving the emission substances, and a display control method in the apparatus.

It is still another object of the present invention to provide an image display apparatus which has emission substances of respective colors laid out in stripes, and adjusts display colors by adjusting charges applied to the emission substances of the respective colors in accordance with designated color adjustment.

To achieve the above objects, an image display apparatus according to the present invention comprises the following arrangement.

That is, an image display apparatus comprises an electron source having a plurality of electron-emitting devices, emission means, having emission substances corresponding to respective colors, for emitting light upon reception of electrons emitted by the electron source, thereby displaying a color image, modulation means for outputting a pulse signal having a pulse width corresponding to an image signal, and voltage control means for controlling a voltage of the pulse signal for driving each of the electron-emitting devices for irradiating the emission substances corresponding to the respective colors with electrons.

Alternatively, an image display apparatus comprises an electron source having a plurality of electron-emitting devices, emission means, having emission substances corresponding to respective colors, for emitting light upon reception of electrons emitted by the electron source, thereby displaying a color image, modulation means for outputting a pulse signal having a pulse width corresponding to an image signal, and current control means for controlling a current of the pulse signal for driving each of the electron-emitting devices for irradiating the emission substances corresponding to the respective colors with electrons.

The current control means desirably comprises a current source for outputting a current corresponding to an application voltage, and voltage control means for controlling the application voltage.

The voltage control means desirably controls the application voltage in accordance with an adjustable input voltage and a reference voltage corresponding to each of the plurality of electron-emitting devices.

It is desirable that the image display apparatus further comprise instruction means for instructing adjustment of a display color, and the voltage control means control the voltage of the pulse signal in accordance with an instruction from the instruction means.

It is desirable that the plurality of electron-emitting devices be laid out in a matrix, and the emission substances corresponding to the respective colors be laid out in stripes in units of colors.

The image display apparatus desirably further comprises scanning driving means for selecting respective scanning lines of the plurality of electron-emitting devices, and applying a predetermined voltage to the selected scanning lines.

The pulse signal output from the modulation means is desirably input to a column wiring of the matrix.

The emission substances corresponding to the respective colors are desirably R, G, and B fluorescent substances.

The electron-emitting device is desirably a cold cathode device.

The electron-emitting device is desirably a surface-conduction emission type electron-emitting device.

The electron-emitting device is desirably an FE type electron-emitting device.

The electron-emitting device is desirably an MIM type electron-emitting device.

Alternatively, an image display apparatus comprises a display panel in which devices are arranged at or near intersections of modulated-signal wirings and scanning wirings, and devices connected to a common modulated-signal wiring emit light of the same color, a control voltage source for supplying an adjustable control voltage corresponding to each color of light emitted by the display panel, a variable current source which is connected to the modulated-signal wiring, receives from the control voltage source a control voltage corresponding to a color of light emitted by devices connected to the modulated-signal wiring, and outputs a current corresponding to the control voltage to the modulated-signal wiring, and a modulated-signal driver for modulating the current output from the variable current source into a pulse having a width corresponding to an image signal value.

It is desirable that the control voltage source include a first voltage source for outputting a first voltage adjustable by an operator and a second voltage source for outputting a second voltage corresponding to correction data for correcting an input/output characteristic of each device, and output a voltage adjusted by the second voltage based on the first voltage.

It is desirable that the display panel have elementary colors laid out in stripes in units of modulated-signal wirings, and the control voltage source be independent for each elementary color.

It is desirable that the display panel comprise a fluorescent plate of colors corresponding to the respective devices, and emit light upon collision with an electron beam emitted by the device.

The device is desirably a cold cathode device.

The device is desirably an electroluminescent device.

Other features and advantages of the present invention will be apparent from the following description taken in conjunction with the accompanying drawings, in which like reference characters designate the same or similar parts throughout the figures thereof.

BRIEF DESCRIPTION OF THE DRAWINGS

The accompanying drawings, which are incorporated in and constitute a part of the specification, illustrate embodiments of the invention and, together with the description, serve to explain the principles of the invention.

FIG. 23 is a block diagram showing a multi-functional image display apparatus using the image display apparatus according to the embodiment;

DETAILED DESCRIPTION OF THE PREFERRED EMBODIMENTS

Preferred embodiments of the present invention will be described in detail below with reference to the accompanying drawings.

A matrix type display panel used in an image display apparatus according to the embodiments of the present invention basically comprises, in a low-profile airtight container, a multi electron source constituted by arranging many electron sources, e.g., many cold cathode devices in a matrix on a substrate, and an image forming member which faces the multi electron source and forms an image upon irradiation of electrons from the multi electron source.

These cold cathode devices can be formed on a substrate at a high alignment precision using a manufacturing technique such as photolithography etching, so that many cathodes can be laid out at a small interval. The cold cathode device or its peripheral portion can be driven at a lower temperature than a thermionic cathode conventionally used in a CRT and the like, and thus the cold cathode device can easily realize a multi electron source having a smaller layout pitch. Note that the structure and manufacturing method of the matrix type display panel will be described later.

Embodiments of the present invention will be described below with reference to the accompanying drawings.

[First Embodiment]

Figure 1:
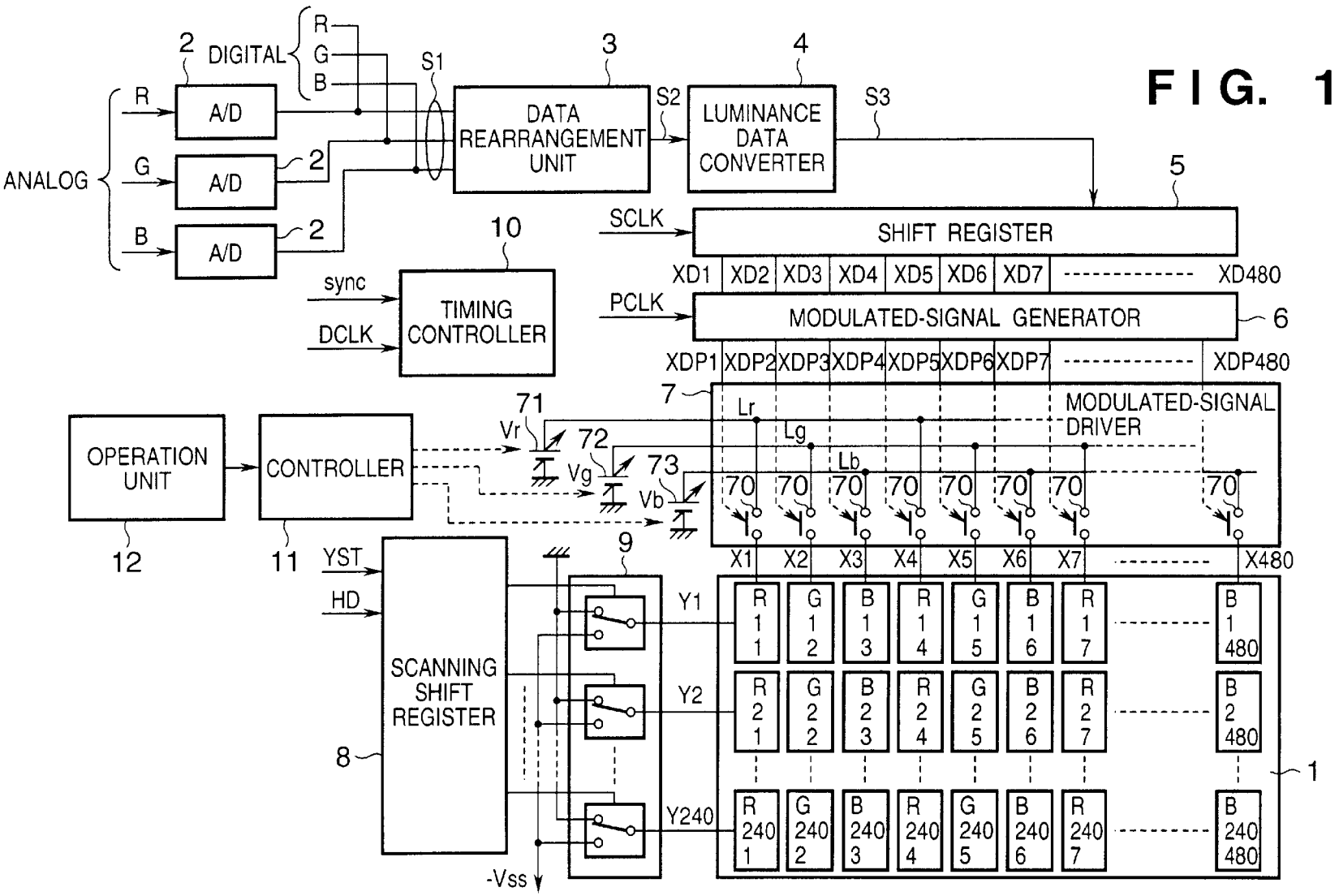
FIG. 1 is a block diagram showing the arrangement of a display driving circuit in an image display apparatus according to the first embodiment of the present invention.

FIG. 1 is a block diagram showing the arrangement of an image display apparatus according to the first embodiment of the present invention.

In FIG. 1, a display panel 1 is a matrix type display panel having many electron sources, e.g., many cold cathode devices arranged in a matrix on a substrate within a low-profile airtight container. For example, 480 devices, i.e., 160 pixels×3 (R, G, and B) are arranged horizontally, wherein 240 devices (240 lines) are arranged vertically. Although the first embodiment exemplifies the matrix type display panel having 480 devices×240 devices, the number of devices of the display panel is not limited to this and can be determined by an intended product application. The cold cathode devices of the matrix type display panel 1 are laid out in accordance with display colors (colors of corresponding fluorescent substances) with Rmn (m=1 to 240, n=1, 4, 7, . . . ), Gmn (m=1 to 240, n=2, 5, 8, . . . ), and Bmn (m=1 to 240, n=3, 6, 9, . . . ). As shown in FIG. 1, the display panel 1 has a pixel layout in which R, G, and B flourescent substances are laid out in stripes.

The flow of image data will be explained. Analog-to-digital converters (A/D converters) 2 convert analog R, G, and B signals decoded from, e.g., an NTSC signal by a decoder (not shown), into 8-bit digital R, G, and B signals. A data rearrangement unit 3 receives digital R, G, and B signals (S1) from the A/D converters 2, computer, or the like, rearranges the digital data in accordance with the pixel layout (in this case, stripes in the order of R, G, and B) of the display panel 1, and outputs the rearranged data as a signal S2. A luminance data converter 4 has a conversion table used to convert input digital data (S2) into a desired luminance characteristic. The luminance data converter 4 performs gamma conversion using, e.g., a gamma conversion table, and outputs a signal S3. A shift register 5 sequentially shifts and transfers serial data transferred from the luminance data converter 4 in synchronism with a shift clock (SCLK), and generates digital data (XD1 to XD480) corresponding to the respective devices of the display panel 1. A modulated-signal generator 6 determines the pulse width of a modulated signal to be output, on the basis of a PWM clock (PCLK) in accordance with digital data from the shift register 5. A modulated-signal driver 7 outputs signals X1 to X480 for driving the modulated-signal lines of the display panel 1 in accordance with pulse signals output from the modulated-signal generator 6. Each of switches 70 is turned on when a pulse signal output from the modulated-signal generator 6 changes to high level, and turns off when the pulse signal changes to low level. Variable power sources 71 to 73 (Vr, Vg, and Vb) can set their output voltages to desired voltage values in accordance with an instruction from a controller 11.

A scanning shift register 8 receives a horizontal scanning sync signal (HD) as a shift clock, and generates scanning line driving data for sequentially driving the scanning wirings (row wirings) of the display panel 1 corresponding to the scanning lines of an input image. A scanning driver 9 sequentially selects the row wirings of the display panel 1 in accordance with an output from the scanning shift register 8, and applies a voltage −Vss to selected row wirings to drive them. A timing controller 10 receives the sample clock (DCLK) and sync signal (sync) of an input image signal, generates various timing signals based on the sample clock and sync signal, and outputs timing signals corresponding to respective functional blocks. The controller 11 controls the output voltages of the power sources 71 to 73 in accordance with an adjustment instruction such as the color temperature or color tone input by key operation of the user through an operation unit 12. Adjustment of the output voltages of the power sources will be described later. The operation unit 12 may be a general volume control, key switch, or the like, or may be a remote controller or the like.

Figure 3:
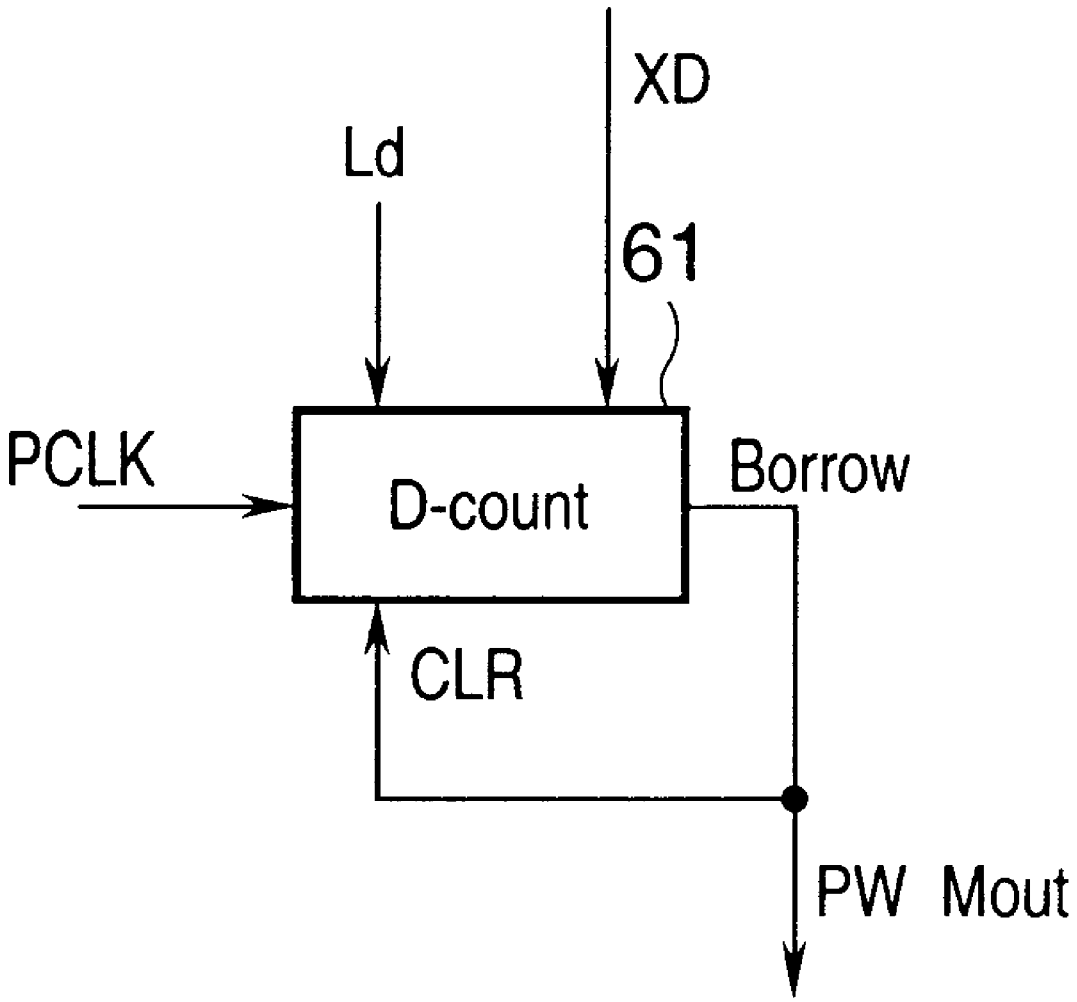
FIG. 3 is a circuit diagram showing the arrangement of a modulation circuit for one signal in a modulated-signal generator according to the first embodiment.
Figure 4:
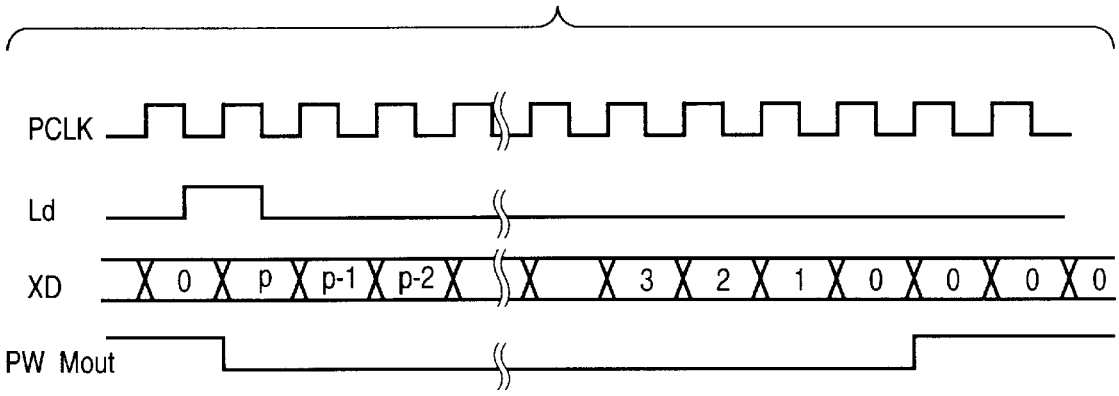
FIG. 4 is a timing chart showing the operation of the circuit in FIG. 3.

FIG. 3 is a block diagram showing the arrangement of a modulated-signal generation circuit for one signal (XD) in the modulated-signal generator 6 according to the first embodiment. FIG. 4 is a timing chart showing the operation of this circuit.

FIG. 3, a down counter 61 loads, e.g., 8-bit digital data (a corresponding one of XD1 to XD480) as an output from the shift register 5 at the timing of a load signal (Ld), and can obtain a pulse width-modulated output which is kept at low level until a number of PWM clocks (PCLK) corresponding to the loaded digital data value are counted after loading. That is, a PWM output is a borrow output from the down counter 61. The borrow output changes to low level after data loading, and when a number of PCLKs corresponding to the number of loaded data are counted, changes to high level to clear the counter 61. Then, a pulse width-modulated signal having a pulse width determined by "loaded image data (setting value)"×"clock (PCLK) period" is output.

FIG. 4 is a timing chart showing the operation of one circuit of the modulated-signal generator 6. In FIG. 4, this circuit outputs a pulse width-modulated signal having a width corresponding to an XD value "p".

Figure 2:
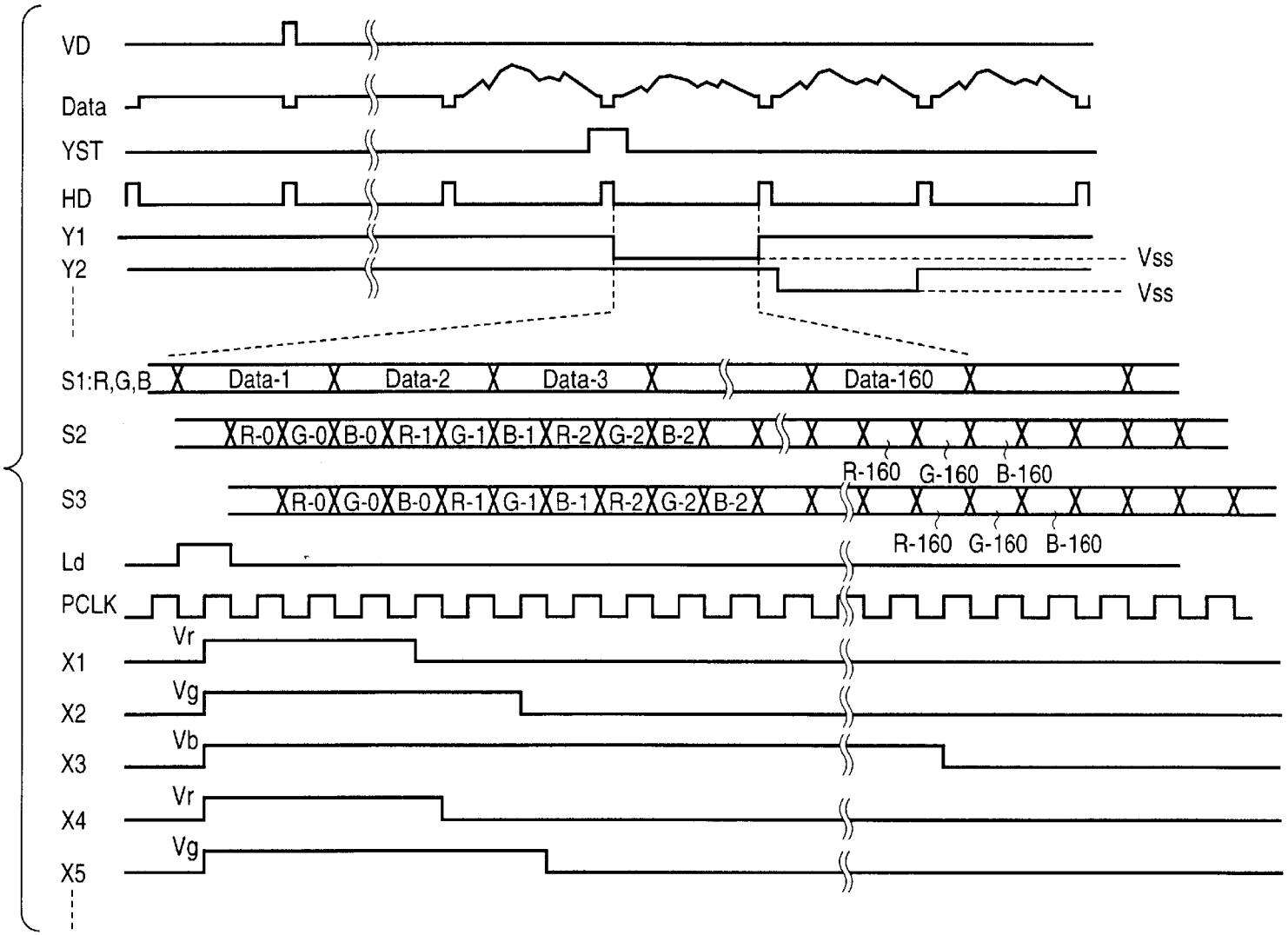
FIG. 2 is a timing chart for explaining the operation timing of the display driving circuit according to the first embodiment.

FIG. 2 is a timing chart showing the operation timing of the circuit shown in FIG. 1.

In FIG. 2, a pulse width-modulated signal output from the modulated-signal driver 7 has a pulse width corresponding to each image data value. The circuit outputs signals having voltages corresponding to R, G, and B, as represented by X1, X2, and X3.

Figure 11:
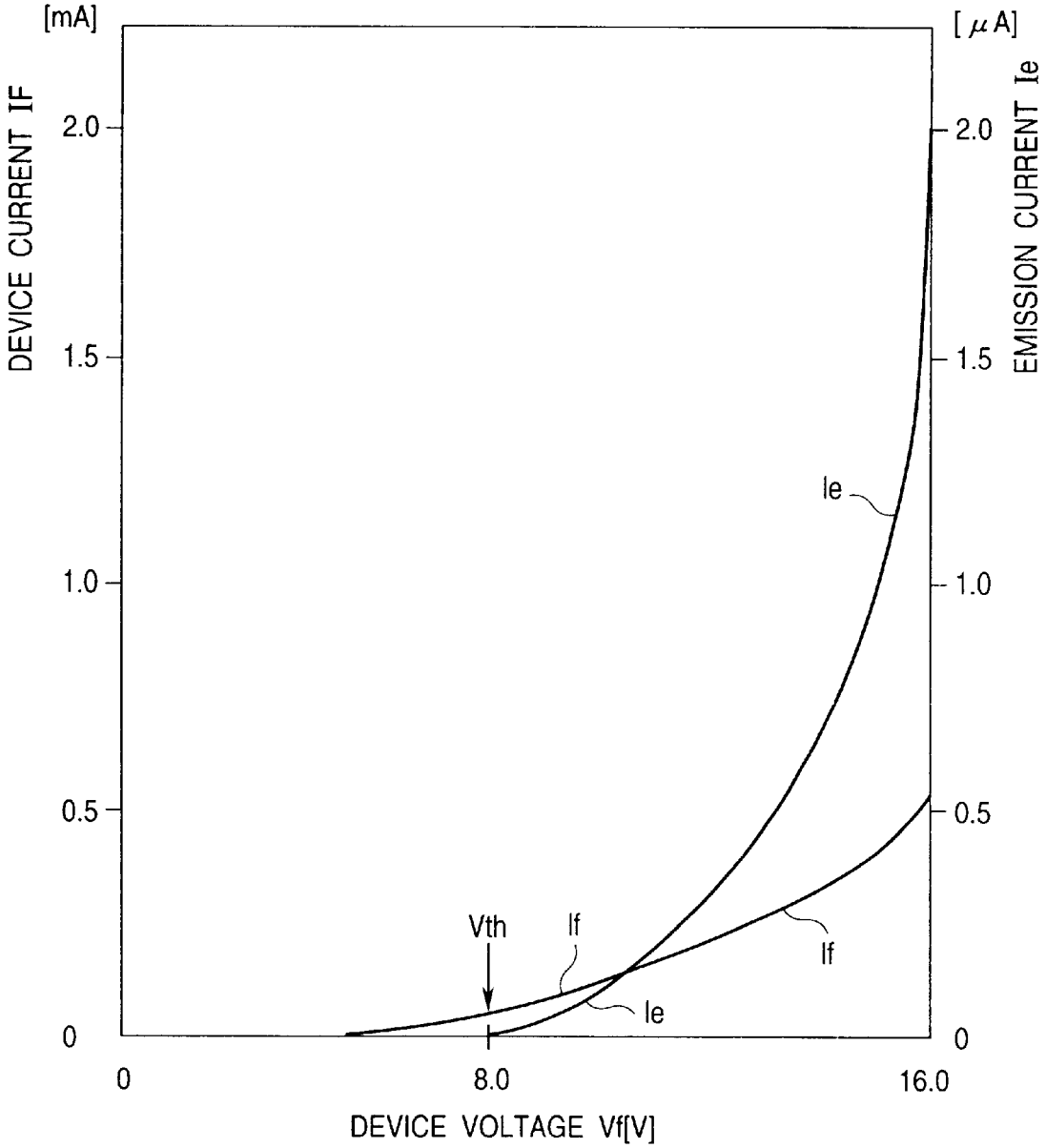
FIG. 11 is a graph showing an example of the characteristics of a cold cathode type electron source according to the embodiment.

FIG. 11 is a graph showing the characteristics of the cold cathode device used in the first embodiment.

The operation of the image display apparatus according to the first embodiment will be explained with reference to FIG. 1.

In FIG. 1, analog R, G, and B signals decoded from, e.g., an NTSC signal by a decoder (not shown) are input and converted into 8-bit digital R, G, and B signals by the A/D converters 2. The data rearrangement unit 3 receives digital R, G, and B signals (S1) from the A/D converters 2, computer, or the like. At this time, processing can be simplified by determining the number of data for one scanning line (1H) on the basis of the number of pixels on the modulated-signal line side of the display panel 1 (the number of display pixels in the horizontal direction). In the first embodiment, the number of pixels on the modulated-signal line side of the display panel 1 is "160". The digital R, G, and B signals (S1) from the A/D converters 2, computer, or the like are output in synchronism with a data sampling clock (DCLK). As shown in FIG. 2, the input signals (S1) to the data rearrangement unit 3 switch the R, G, and B parallel signals at the timing of a shift clock (SCLK) having a frequency three times the frequency of the data sampling clock (DCLK). The R, G, and B parallel signals are sequentially output in accordance with the layout of R, G, and B pixels on the display panel 1.

Output signals (S2) from the data rearrangement unit 3 are input to the luminance data converter 4. The luminance data converter 4 serially outputs the output signals (S2) from the data rearrangement unit 3, e.g., signals (S3) having a luminance characteristic such as a CRT gamma characteristic using a conversion table (ROM) (not shown) which stores desired data in advance. The outputs S3 from the luminance data converter 4 are sent to the shift register 5 where the outputs S3 are sequentially shifted and transferred in synchronism with the shift clock (SCLK). Then, the outputs S3 are converted into digital data (XD1 to XD480) corresponding to the respective devices of the display panel 1. Image data converted into the parallel signals are output every horizontal scanning period. For: example, 8-bit digital data (XD1 to XD480) are input to the modulated-signal generator 6.

As described above, the modulated-signal generator 6 determines the pulse width for each device in accordance with digital data ("setting value") and the PWM clock (PCLK) In other words, the modulated-signal generator 6 outputs a signal having a pulse width determined by a time required for "the number of PWM clocks (PCLK)" to reach "the setting value". An output from the modulated-signal generator 6 controls each switch 70 of the modulated-signal driver 7 to turn on the switch 70 for the pulse width time determined by the modulated-signal generator 6. One terminal of the switch 70 is connected to a modulated-signal line commonly connected to cold cathode devices corresponding to fluorescent substances of the same color. The other terminal of the switch 70 is connected to a power source corresponding to fluorescent substances of the same color as that of the connected switch. More specifically, the switches 70 for outputting modulated signals X1, X4, . . . are connected to the power source 71 (Vr), the switches 70 for outputting modulated signals X2, X5, . . . are connected to the power source 72 (Vg), and the switches 70 for outputting modulated signals X3, X6, . . . , X480 are connected to the power source 73 (Vb). This realizes color adjustment in units of colors.

In order to display NTSC signals on the display panel 1 having 240 scanning lines in the first embodiment, 480 of 485 interlaced effective scanning lines are driven to overwrite signals on the display panel 1 every field. One field of NTSC signals is processed as one frame on the display panel 1. That is, the display panel 1 is driven at a frame frequency of 60 Hz by image signals of the 240 scanning lines.

The time necessary for displaying one scanning line is about 63.5 μsec for the NTSC signal, and about 56.5 μsec out of 63.5 μsec is determined as the maximum time of a driving pulse (X1 to X480). Since digital data ("setting value") is made of 8 bits, the frequency of the PWM clock (PCLK) is selected to have about 56.5 μsec when the number of PWM clock (PCLK) pulses is 256. That is, the PWM clock (PCLK) is a clock having a pulse width of about 220 nsec for one pulse and a frequency of about 4.5 MHz.

The scanning shift register 8 receives a horizontal scanning sync signal (HD) as a shift clock, and outputs scanning signals by sequentially transferring signals (YST) for determining the scanning start timing in accordance with the horizontal scanning sync signal (HD), as shown in FIG. 2. The scanning driver 9 drives the scanning wirings of the display panel 1 sequentially from the first wiring at −Vss (e.g., −Vth: −8V, and 0 V for the remaining wirings) in accordance with scanning signals output from the scanning shift register 8.

When the switch 70 of the modulated-signal driver 7 is ON, the voltage Vr [V] of the power source 71 is applied to a modulated-signal line connected to cold cathode devices corresponding to red fluorescent substance. Similarly, the voltage Vg [V] of the power source 72 is applied to a modulated-signal line connected to cold cathode devices corresponding to green fluorescent substance. The voltage Vb [V] of the power source 73 is applied to a modulated-signal line connected to cold cathode devices corresponding to blue fluorescent substance. The voltages Vr [V], Vg [V], and Vb [V] of the power sources 71, 72, and 73 are set to, e.g., +Vth (about +8 V) in a normal state. Accordingly, a voltage of about 16 V is applied to a cold cathode device which is connected to a scanning wiring (−Vss: −8 V is applied) selected by the scanning driver 9, and connected to a modulated-signal line on which the switch 70 of the modulated-signal driver 7 is ON (about +8 V is applied). Accordingly, the cold cathode device emits electrons. At this time, a voltage of about 8 V is applied to even cold cathode devices connected to scanning wirings (0 V) not selected by the scanning driver 9. However, as is apparent from FIG. 11, the voltage applied to the devices connected to the scanning wirings is equal to or less than the threshold voltage Vth. Hence, the cold cathode devices connected to the unselected scanning wirings emit no electrons, and fluorescent substances corresponding to these devices are not excited and do not emit light.

When the switch 70 of the modulated-signal driver 7 is OFF (0 V), the voltage of the modulated-signal line is 0 V. Cold cathode devices on a selected scanning wiring (−Vss: −8 V is applied) receive a voltage of 8 V. However, as is apparent from FIG. 11, the voltage applied to the cathodes is equal to or less than the threshold voltage Vth. Thus, the corresponding cold cathode devices do not emit any electrons, and fluorescent substances corresponding to these cold cathode devices do not emit light.

As described above, an output from the modulated-signal driver 7 is applied with a pulse width proportional to a desired luminance to each device on a scanning wiring selected by the scanning driver 9. The driving voltage is sequentially applied to form an image on the display panel 1.

In this case, color adjustment is done as follows.

More specifically, when the switches 70 of the modulated-signal driver 7 are ON, the voltage Vr [V] of the power source 71 is applied to modulated-signal lines (signals X1, X4, . . . ) connected to cold cathode devices corresponding to red fluorescent substance. The cold cathode devices corresponding to red fluorescent substance receive a voltage (Vth+Vr) [V]. Similarly, cold cathode devices corresponding to green fluorescent substance receive a voltage (Vth+Vg) [V], and cold cathode devices corresponding to blue fluorescent substance receive a voltage (Vth+Vb) [V].

When the user wants to emphasize, e.g., a red component, he/she instructs this using the key of the operation unit 12. Then, the controller 11 adjusts the output voltage of a corresponding power source in accordance with the instruction. The voltages Vr [V], Vg [V], and Vb [V] of the power sources 71, 72, and 73 whose voltages can be set are set to desired voltage values, thereby achieving color adjustment. In this case, as is apparent from FIG. 11, the emission current is small for a low voltage applied to the cold cathode, and is large for a high voltage applied to the cold cathode. In a normal state, $$Vr[\mathrm{V}]\approx Vg[\mathrm{V}]\approx Vb[\mathrm{V}]$$

yields almost the same emission currents from cold cathode devices corresponding to fluorescent substances of the respective colors. This provides normal colors. If, for example, the user instructs to adjust an image to be more bluish than the normal state, the voltages are set to $$Vr[\mathrm{V}]\approx Vg[\mathrm{V}]<Vb[\mathrm{V}]$$

At this time, only an emission current from cold cathode devices corresponding to blue fluorescent substance can be set larger than emission currents from cold cathode devices corresponding to fluorescent substances of the remaining colors. The blue luminance can relatively increase to adjust the image to a bluish one.

To adjust an image to be more reddish than the normal state, the voltages are set to $$Vr[\mathrm{V}]>Vg[\mathrm{V}]\approx Vb[\mathrm{V}]$$

To display an image of only green as a special effect, the voltages are set to $$Vr[\mathrm{V}]\approx Vb[\mathrm{V}]\approx 0[\mathrm{V}],\ Vg[\mathrm{V}]\approx Vth[\mathrm{V}]$$

At this time, cold cathode devices corresponding to fluorescent substances of the colors other than green hardly emit any emission currents. Only emission currents from cold cathode devices corresponding to green fluorescent substances can irradiate these fluorescent substances. That is, an image of only green can be obtained.

By realizing the image display apparatus of the first embodiment, the present invention can provide an image display apparatus capable of performing color adjustment with a simple hardware arrangement.

[Second Embodiment]

Figure 5:
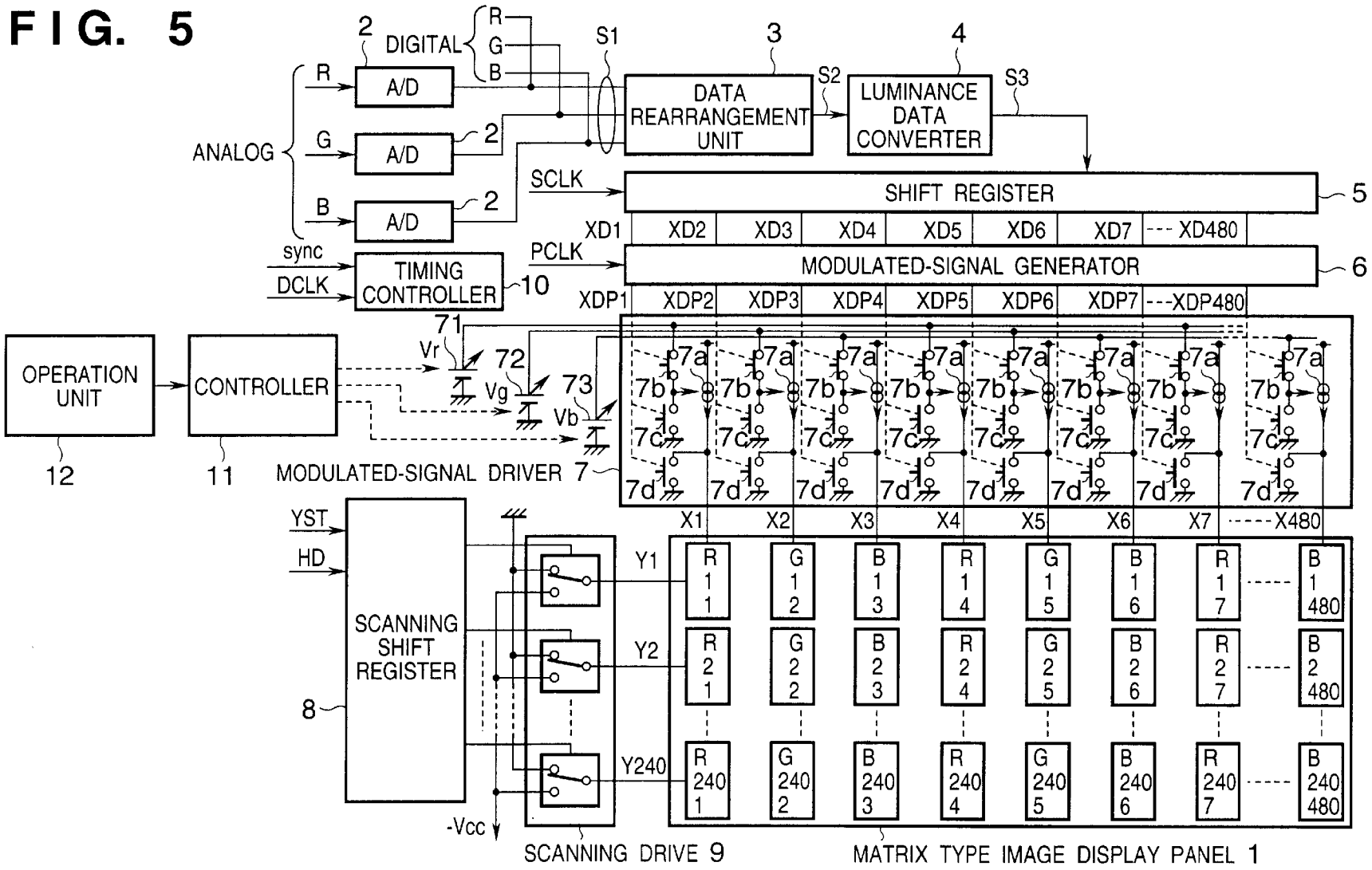
FIG. 5 is a block diagram showing the arrangement of a display driving circuit in an image display apparatus according to the second embodiment.

FIG. 5 is a block diagram showing an image display apparatus according to the second embodiment of the present invention. In FIG. 5, a matrix type image display panel 1 comprises a multi electron source constituted by arranging many electron sources, e.g., many cold cathode devices on a substrate within a low-profile airtight container. For example, 480 devices, i.e., 160 pixels×3 (R, G, and B) are arranged horizontally, wherein 240 devices are arranged vertically. Although the second embodiment exemplifies the matrix type image display panel having 480 devices×240 devices, the number of devices is not limited to this and can be determined by an intended product application. The cold cathode devices of the matrix type image display panel 1 are laid out in accordance with image display colors (colors of corresponding fluorescent substances) with Rm,n (n=1, 4, 7, . . . ), Gm,n (n=2, 5, 8, . . . ), and Bm,n (n=3, 6, 9, . . . ). As shown in FIG. 5, the matrix type image display panel 1 has a pixel layout of R, G, and B stripes. Analog-to-digital converters (A/D converters) 2 convert analog R, G, and B component signals decoded from, e.g., an NTSC signal by a decoder (not shown), into 8-bit digital R, G, and B signals. A data rearrangement unit 3 has a function of receiving digital R, G, and B signals (to be referred to as a signal S1) from the A/D converters 2, computer, or the like, rearranging the digital data in accordance with the pixel layout of the matrix type image display panel 1, and outputting the rearranged data (to be referred to as a signal S2). A luminance data converter 4 has a conversion table used to convert input digital data into a desired luminance characteristic, and executes, e.g., gamma conversion (an output signal will be referred to as S3). A shift register 5 sequentially shifts and transfers serial data sent from the luminance data converter 4 in synchronism with a shift clock (SCLK), and generates digital data (XD1 to XD480) corresponding to the respective devices of the matrix type image display panel 1. A modulated-signal generator 6 determines the pulse width on the basis of a PWM clock (PCLK) in accordance with digital data from the shift register 5. A modulated-signal driver 7 drives the modulated-signal lines of the display panel 1 in accordance with pulse signals output from the modulated-signal generator 6 (driving signals will be referred to as X1 to X480).

Each current source 7*a* outputs a current value proportional to the voltage of a control terminal. Switches 7*b*, 7*c*, and 7*d* are turned on/off in accordance with the output logic level of the modulated-signal generator 6. Power sources 71, 72, and 73 can set desired output voltage values.

A scanning shift register 8 receives a horizontal scanning sync signal (HD) as a shift clock, and generates data for sequentially driving the scanning wirings of the matrix type image display panel 1 corresponding to the scanning lines of an input image. A scanning driver 9 sequentially drives the scanning wirings of the matrix type image display panel 1 in accordance with an output from the scanning shift register 8. A timing controller 10 generates a desired timing control signal for each functional block on the basis of the sync signal and sampling clock (DCLK) of an input image.

A controller 11 controls the output voltages of the power sources 71 to 73 in accordance with an adjustment instruction such as the color temperature or color tone input by key operation of the user through an operation unit 12. Adjustment of the output voltages of the power sources will be described later. The operation unit 12 may be a general volume control, key switch, or the like, or may be a remote controller or the like.

Figure 10A:
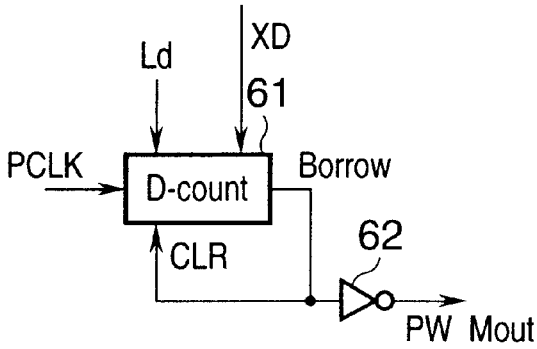
FIGS. 10A and 10B are a block diagram and timing chart, respectively, showing a modulated-signal generator.
Figure 10B:
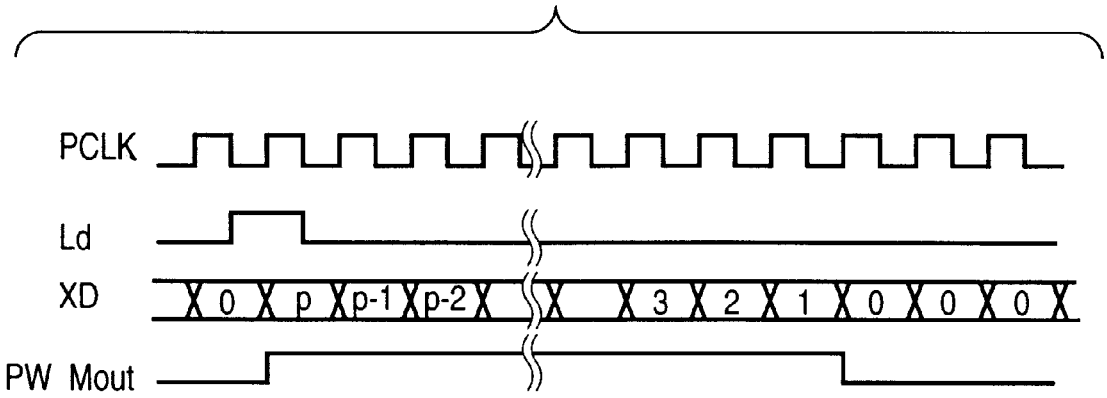

FIG. 10A is a block diagram showing the modulated-signal generator 6 according to the second embodiment. In FIG. 10A, a down counter 61 loads, e.g., 8-bit digital data (each of XD1 to XD480) as an output from the shift register 5 in accordance with a load signal (Ld), and counts down PWM clocks (PCLK). A borrow output from the down counter 61 is inverted by an inverter 61 into a pulse width-modulated output. That is, the inverter 62 outputs a pulse having a width determined by "loaded data "×" clock (PCLK) period". FIG. 10B is a timing chart showing the signals PCLK, Ld, and PWMout in loading a value p as a signal XD to the modulated-signal generator 6. In this way, the modulated-signal generator 6 outputs a pulse of the loaded value p×PCLK period.

Figure 6:
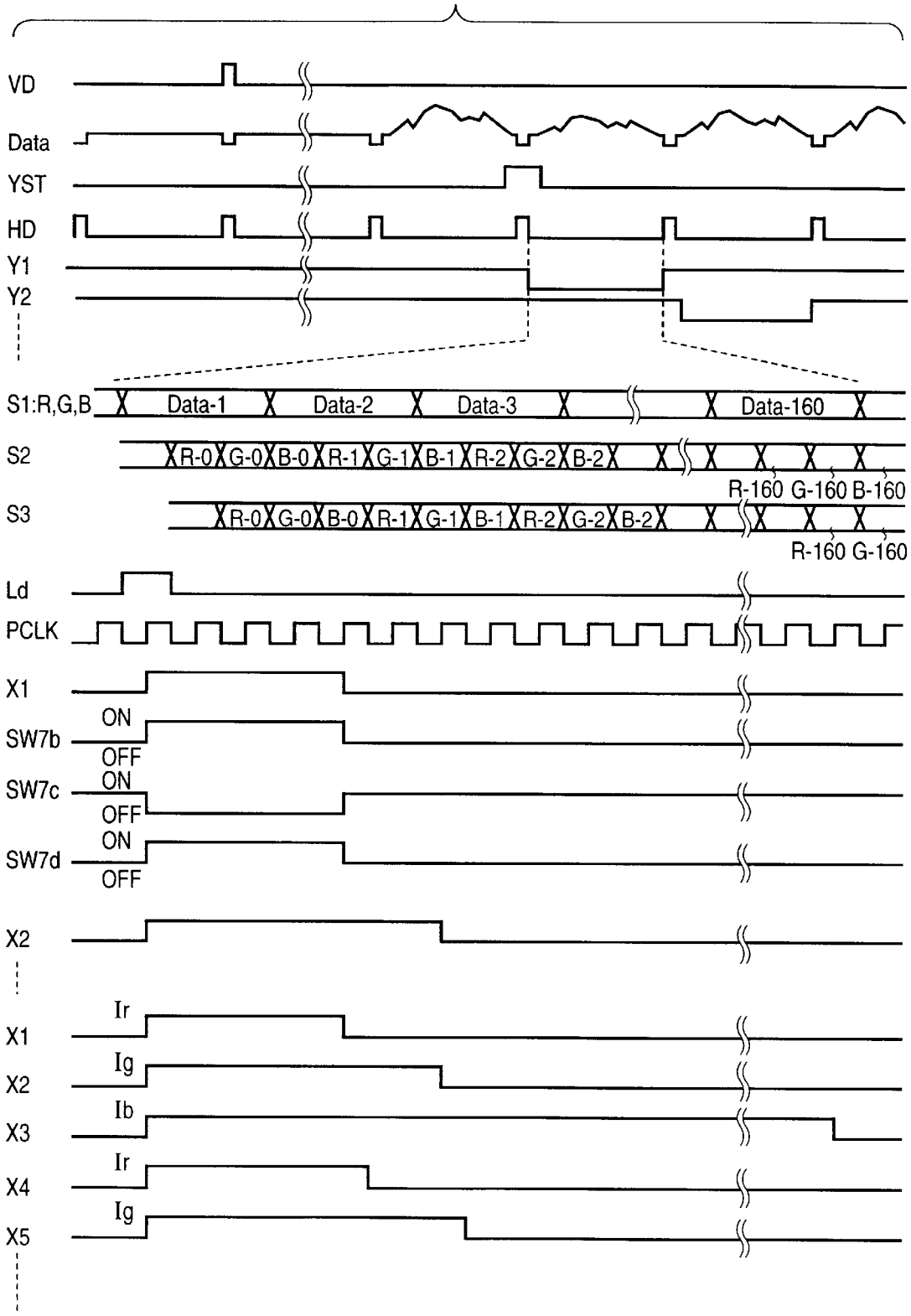
FIG. 6 is a timing chart for explaining the operation timing of the display driving circuit according to the second embodiment.

FIG. 6 is a timing chart showing respective signals in the second embodiment. The operation of the image display apparatus in the second embodiment will be explained with reference to FIG. 6.

In FIG. 5, analog R, G, and B component signals decoded from, e.g., an NTSC signal by a decoder (not shown) are input to the A/D converters 2. The A/D converters 2 convert the input R, G, and B signals into 8-bit digital R, G, and B signals. The data rearrangement unit 3 receives the digital R, G, and B signals (S1) from the A/D converters 2 or a digital device such as a computer. At this time, processing can be simplified by determining the number of data for one scanning line (1H) on the basis of the number of pixels on the modulated-signal line side of the display panel 1, i.e., the number of columns of the shift register 5. In the second embodiment, the number of pixels on the modulated-signal line side of the matrix type image display panel 1 is 160. The digital R, G, and B signals (S1) from the A/D converters 2 or a digital device such as a computer are output in synchronism with a data sampling clock (DCLK) (not shown). As shown in FIG. 6, the input signals (S1) to the data rearrangement unit 3 are R, G, and B parallel signals. The data rearrangement unit 3 selects signals of one color from the R, G, and B parallel signals, and outputs them as signals S2. The selected color is switched at the timing of a shift clock SCLK (not shown) having a frequency three times the frequency of the data sampling clock (DCLK) Signals of R, G, and B colors are switched every shift clock period, and sequentially output in accordance with the layout of R, G, and B pixels on the matrix type image display panel 1.

Output signals (S2) from the data rearrangement unit 3 are input to the luminance data converter 4. The luminance data converter 4 converts the output signals (S2) from the data rearrangement unit 3 in accordance with the luminance characteristic such as a CRT gamma characteristic using a conversion table (ROM) (not shown) which stores desired data in advance. Then, the luminance data converter 4 outputs the converted signals as signals S3.

The outputs S3 from the luminance data converter 4 are input to the shift register 5. The input data are sequentially shifted in synchronism with the shift clock (SCLK). The shift register 5 outputs, to the modulated-signal generator 6, digital data (XD1 to XD480) of one row corresponding to the respective devices of the matrix type image display panel 1 every horizontal scanning period. The modulated-signal generator 6 holds the input values for one horizontal scanning period, and outputs pulses having widths determined in accordance with the input values. For example, 8-bit digital data (XD1 to XD480) are input to the modulated-signal generator 6. As shown in FIG. 10, the modulated-signal generator 6 determines the pulse width for each device in accordance with digital data ("setting value") and the PWM clock (PCLK). In other words, the modulated-signal generator 6 outputs a pulse width determined by a time required for "the number of PWM clocks (PCLK)" to reach "the setting value".

When the output logic level of the modulated-signal generator 6 changes to "H", the switch 7*b* of the modulated-signal driver 7 is turned on, and the switches 7*c* and 7*d* are turned off. Then, a current from the current source 7*a* is output to the modulated-signal wiring (X1, X2, X3, . . . , X480) for the pulse width time of logic level "H" determined by the modulated-signal generator 6. When the output logic level of the modulated-signal generator 6 changes to "L", the switch 7*b* of the modulated-signal driver 7 is turned off, and the switches 7*c* and 7*d* are turned on. Then, the modulated-signal wiring (X1, X2, X3, . . . , X480) changes to GND level for the pulse width time of logic level "L" determined by the modulated-signal generator 6. Since the switch 7*b* is OFF and the switch 7*c* is ON, an output current from the current source 7*a* can be decreased to almost 0 A. This can reduce the power consumption of the modulated-signal driver 7.

The control terminals of the current sources 7*a* are connected to a common power source for each color. More specifically, the control terminals of the current sources 7*a* connected to the modulated-signal wirings X1, X4 . . . on R columns are connected to the power source 71. The control terminals of the current sources 7*a* connected to the modulated-signal wirings X2, X5, . . . on G columns are connected to the power source 72. The control terminals of the current sources 7*a* connected to the modulated-signal wirings X3, X6, . . . , X480 on B columns are connected to the power source 73.

In order to display NTSC signals on the matrix type image display panel 1 having 240 scanning lines by the image display apparatus having the above arrangement according to the second embodiment, 480 of 485 interlaced effective scanning lines are driven to overwrite the signals on the matrix type image display panel 1 every field. One field of NTSC signals is processed as one frame on the image display panel 1. This is, the display panel 1 is driven at a frame frequency of 60 Hz by image signals of the 240 scanning lines.

The time necessary for displaying one scanning line is about 63.5 μsec for the NTSC signal. In the second embodiment, about 56.5 μsec out of 63.5 μsec is determined as the maximum time of a driving pulse (X1 to X480). Since digital data ("setting value") is made up of 8 bits, "PCLK period"$\times 2^8$ is the maximum pulse width of 56.5 μsec. Therefore, the PCLK period, i.e., pulse width corresponding to one input pixel value is about 220 nsec, and the PWM clock frequency is about 4.5 MHz.

The scanning shift register 8 receives a horizontal scanning sync signal (HD) as a shift clock, and outputs scanning signals by sequentially transferring signals (YST) for determining the scanning start timing in accordance with the horizontal scanning sync signal (HD), as shown in FIG. 6. The scanning driver 9 drives scanning wirings sequentially from the first wiring at a potential of −Vss (e.g., −Vth: −8V, and 0 V for the remaining wirings) in accordance with scanning signals output from the scanning shift register 8.

When the output logic level of the modulated-signal generator 6 changes to "H", the switch 7*b* of the modulated-signal driver 7 is turned on, and the switches 7*c* and 7*d* are turned off. Then, a current from the current source 7*a* is output to the modulated-signal wiring (X1, X2, X3, . . . , X480) for the pulse width time of logic level "H" determined by the modulated-signal generator 6.

Cold cathode devices corresponding to red fluorescent substance are connected to the modulated-signal wirings X1, X4, . . . The current sources 7*a* connected to these modulated-signal wirings receive the voltage Vr [V] at their control terminals, and output a current Ir [A] proportional to the voltage Vr [V]. Similarly, cold cathode devices corresponding to green fluorescent substances are connected to the modulated-signal wirings X2, X5, . . . The current sources 7*a* connected to these modulated-signal wirings receive the voltage Vg [V] at their control terminals, and output a current Ig [A] proportional to the voltage Vg [V]. Cold cathode devices corresponding to blue fluorescent substances are connected to the modulated-signal wirings X3, X6, . . . , X480. The current sources 7*a* connected to these modulated-signal wirings receive the voltage Vb [V] at their control terminals, and output a current Ib [A] proportional to the voltage Vb [V].

The currents Ir [A], Ig [A], and Ib [A] are currents for driving cold cathode devices, and have current values enough for the cold cathode devices to emit electrons. For example, in FIG. 5, the currents Ir [A], Ig [A], and Ib [A] are determined to device current values when the device voltage is 16 V. The voltages Vr [V], Vg [V], and Vb [V] are determined from voltages for setting the current values of the currents Ir [A], Ig [A], and Ib [A].

The currents Ir [A], Ig [A], and Ib [A] flow through cold cathode devices which are connected to a scanning wiring (driven by −Vss: −8 V) selected by the scanning driver 9 and connected to modulated-signal lines during output logic level "H" of the modulated-signal generator 6. Then, these cold cathode devices emit electrons. Since a voltage of about 16 V is applied to the devices at this time, as described above, the voltage of the modulated-signal wirings is about 8 V during output logic level "H" of the modulated-signal generator 6. At the same time, a voltage of about 8 V is applied to cold cathode devices connected to scanning wirings (driven by 0 V) not selected by the scanning driver 9. However, as is apparent from FIG. 11, the cold cathode devices connected to the scanning wirings not selected by the scanning driver 9 emit no electrons. Thus, corresponding substances of the matrix type image display panel 1 do not emit light.

When the output logic level of the modulated-signal generator 6 changes to "L", the voltage of the modulated-signal wirings changes to 0 V by the switches 7*d*, and a voltage of about 8 V is applied to cold cathode devices connected to selected scanning wirings (driven by −Vss: −8 V). As is apparent from FIG. 11, these cold cathode devices emit no electrons. Hence, corresponding substances of the matrix type image display panel 1 do not emit light.

Accordingly, an output from the modulated-signal driver 7 is applied with a pulse width proportional to a desired luminance to each device on a scanning wiring selected by the scanning driver 9. The driving voltage is sequentially applied to form an image on the matrix type image display panel 1.

Color adjustment is done as follows.

During output logic level "H" of the modulated-signal generator 6, the current Ir [A] of the current source 7*a* is output to the modulated-signal lines (X1, X4, . . . ) connected to cold cathode devices corresponding to red fluorescent substance. The current Ir [A] flows through the cold cathode devices corresponding to red fluorescent substance. Similarly, the current Ig [A] flows through cold cathode devices corresponding to green fluorescent substance, and the current Ib [A] flows through cold cathode devices corresponding to blue fluorescent substances.

The voltages Vr [V], Vg [V], and Vb [V] of the power sources 71, 72, and 73 whose voltages can be set are set to desired voltage values, thereby changing currents flowing through cold cathode devices. As a result, color adjustment is performed. As is apparent from FIG. 11, the emission current is small for a small driving current flowing through the cold cathode device, and is large for a large driving current flowing through it. In a normal state, $$Vr[\mathrm{V}] \approx Vg[\mathrm{V}] \approx Vb[\mathrm{V}]$$

yields almost the same driving currents Ir [A], Ig [A], and Ib [A] flowing through cold cathode devices corresponding to fluorescent substances of the respective colors. Emission currents from the cold cathode devices corresponding to fluorescent substances of the respective colors can be made almost equal, thereby providing normal colors.

If, for example, the user wants to adjust an image to be more bluish than the normal state, the voltages are set to $$Vr[\mathrm{V}] \approx Vg[\mathrm{V}] < Vb[\mathrm{V}]$$

At this time, the driving current Ib [A] flowing through cold cathode devices corresponding to blue fluorescent substance can be set larger than the driving currents Ir [A] and Ig [A] flowing through cold cathode devices corresponding to fluorescent substances of the remaining colors. Thus, an emission current from cold cathode devices corresponding to blue fluorescent substance can be set larger than emission currents from cold cathode devices corresponding to fluorescent substances of the remaining colors. The blue luminance can relatively increase to adjust the image to a bluish one.

To adjust an image to be more reddish than the normal state, the voltages are set to $$Vr[\mathrm{V}] > Vg[\mathrm{V}] \approx Vb[\mathrm{V}]$$

To display an image of only green as a special effect, the voltages are set to $$Vr[\mathrm{V}] \approx Vb[\mathrm{V}] \approx 0[\mathrm{V}],\ Vg[\mathrm{V}] \approx Vth[\mathrm{V}]$$

At this time, cold cathode devices corresponding to fluorescent substances of the colors other than green hardly emit any emission currents. Only an emission current from cold cathode devices corresponding to green fluorescent substance can irradiate the fluorescent substance. That is, an image of only green can be obtained.

By realizing the image display apparatus having the above arrangement according to the second embodiment, the present invention can provide an image display apparatus capable of performing color adjustment with a simple hardware arrangement.

(Detailed Arrangement of Modulated-Signal Driver)

Figure 7:
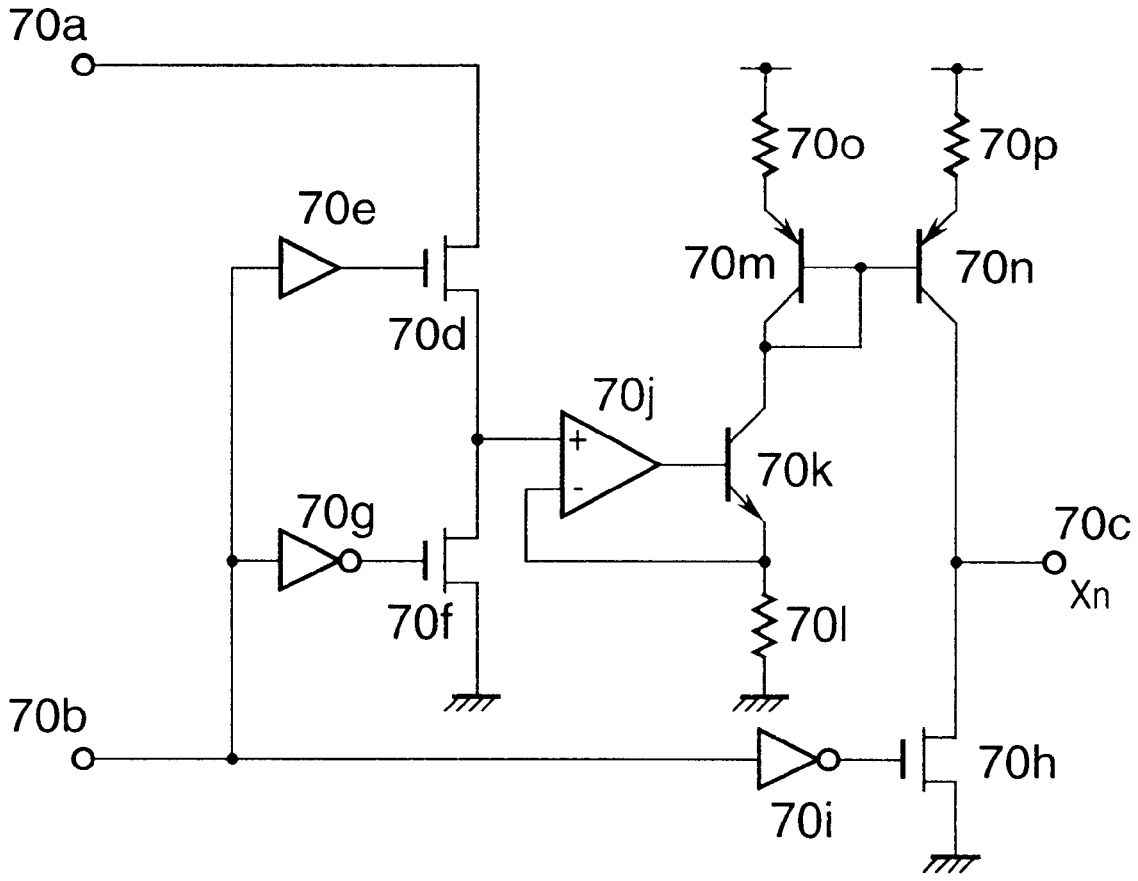
FIG. 7 is a circuit diagram showing details of a modulated-signal driver in the display driving circuit according to the second embodiment.

FIG. 7 shows details of one modulated-signal line of the modulated-signal driver according to the present invention. In FIG. 7, an input terminal 70*a* receives an output current from the power source 71, 72, or 73. An input terminal 70*b* receives an output from the modulated-signal generator 6.

The input terminal 70*b* is connected to the gate of a MOSFET 70*d* via a buffer 70*e*, and to the gates of MOSFETs 70*f* and 70*h* via inverters 70*g* and 70*i*. During logic level "H" of the input terminal 70*b*, the switch 70*d* is ON, and the switches 70*f* and 70*h* are OFF. The collector current of an NPN transistor 70*k* is determined by a current value proportional to the voltage at the non-inverting input of an operational amplifier 70*j*. That is, a voltage-controlled current source is established. PNP transistors 70*m* and 70*n* and resistors 70*o* and 70*p* constitute a current mirror circuit, which outputs to an output terminal 70*c* a current output with the same current value as the collector current of the NPN transistor 70*k*. At this time, the MOSFET 70*h* is kept off.

With this arrangement, the modulated-signal driver drives the matrix type image display panel.

The MOSFETs 70*d* and 70*f* are used as switches in this example, but the switches may be general junction type transistors or analog switches.

[Third Embodiment]

Figure 8:
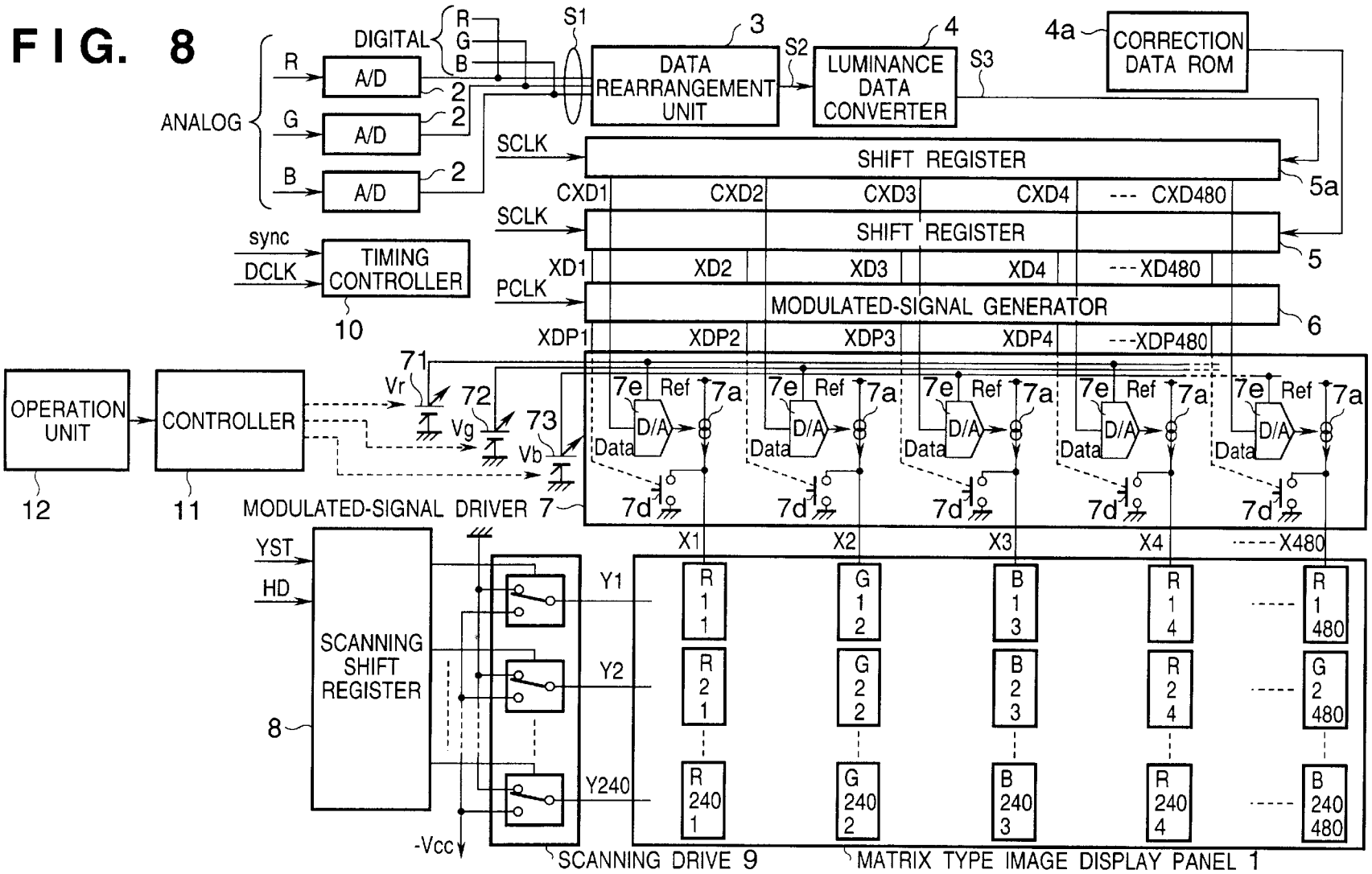
FIG. 8 is a block diagram showing the arrangement of a display driving circuit in an image display apparatus according to the third embodiment.

FIG. 8 is a block diagram showing an image display apparatus according to the third embodiment of the present invention. In FIG. 8, the same reference numerals as in FIG. 5 denote the same parts, and a description thereof will be omitted. In FIG. 8, a ROM 4*a* stores correction data, and sequentially outputs driving current data corresponding to a cold cathode at the same rate as luminance data by an address generator (not shown). The correction data is used to correct variations in electron-emitting characteristics between devices, and is measured in advance. A shift register 5*a* sequentially transfers correction data output from the ROM 4*a*. A modulated-signal driver 7 includes current sources 7*a*, switches 7*d*, and D/A converters 7*e* for determining an output current in accordance with the control voltage in order to generate signals to be supplied to respective column wirings. Cold cathode devices corresponding to red fluorescent substance are connected to modulated-signal wirings X1, X4, . . . The control terminals of the variable current sources 7*a* connected to the modulated-signal wirings X1, X4, . . . are connected to the output terminals of D/A converters 7*e*. Each D/A converter 7*e* has a reference voltage input terminal Ref and data input terminal Data. The reference voltage input terminal is connected to a power source 71 to receive a voltage Vr [V], whereas the data input terminal is connected to a corresponding digit position of the shift register 5*a* to receive correction data. The current source 7*a* outputs a current Ir [A] proportional to correction data input via the data input terminal on the basis of the reference voltage Vr [V]. The D/A converter 7*e* outputs a voltage, e.g., obtained by adding a voltage corresponding to correction data to the reference voltage as a minimum value, or subtracting a voltage corresponding to correction data from the reference voltage as a maximum value.

Similarly, cold cathode devices corresponding to green fluorescent substances are connected to modulated-signal wirings X2, X5, . . . The control terminals of the variable current sources 7*a* connected to the modulated-signal wirings X2, X5, . . . are connected to the output terminals of corresponding D/A converters 7*e*. Each D/A converter 7*e* has the reference voltage input terminal Ref and data input terminal Data. The reference voltage input terminal is connected to a power source 72 to receive a voltage Vg [V], whereas the data input terminal is connected to a corresponding column of the shift register 5*a* to receive correction data. The current source 7*a* outputs a current Ig [A] proportional to correction data input via the data input terminal on the basis of the reference voltage Vg [V].

Cold cathode devices corresponding to blue fluorescent substances are connected to modulated-signal wirings X3, X6, . . . , X480. The control terminals of the variable current sources 7*a* connected to the modulated-signal wirings X3, X6, . . . are connected to the output terminals of corresponding D/A converters 7*e*. Each D/A converter 7*e* has the reference voltage input terminal Ref and data input terminal Data. The reference voltage input terminal is connected to a power source 73 to receive a voltage Vb [V], whereas the data input terminal is connected to a corresponding column of the shift register 5*a* to receive correction data. The current source 7*a* outputs a current Ib [A] proportional to correction data input via the data input terminal on the basis of the reference voltage Vb [V].

The third embodiment as well as the second embodiment can adjust the luminances of the respective colors by changing the voltages Vr, Vg, and Vb, and can perform color adjustment. Further, the third embodiment reflects correction data on the driving current of the cold cathode device, and thus can apply an input signal suitable for the input/output characteristic of each device.

By realizing the image display apparatus having the above arrangement according to the present invention, the present invention can provide an image display apparatus capable of determining the driving current of each cold cathode device, and performing color adjustment of the apparatus with a simple hardware arrangement.

Figure 9:
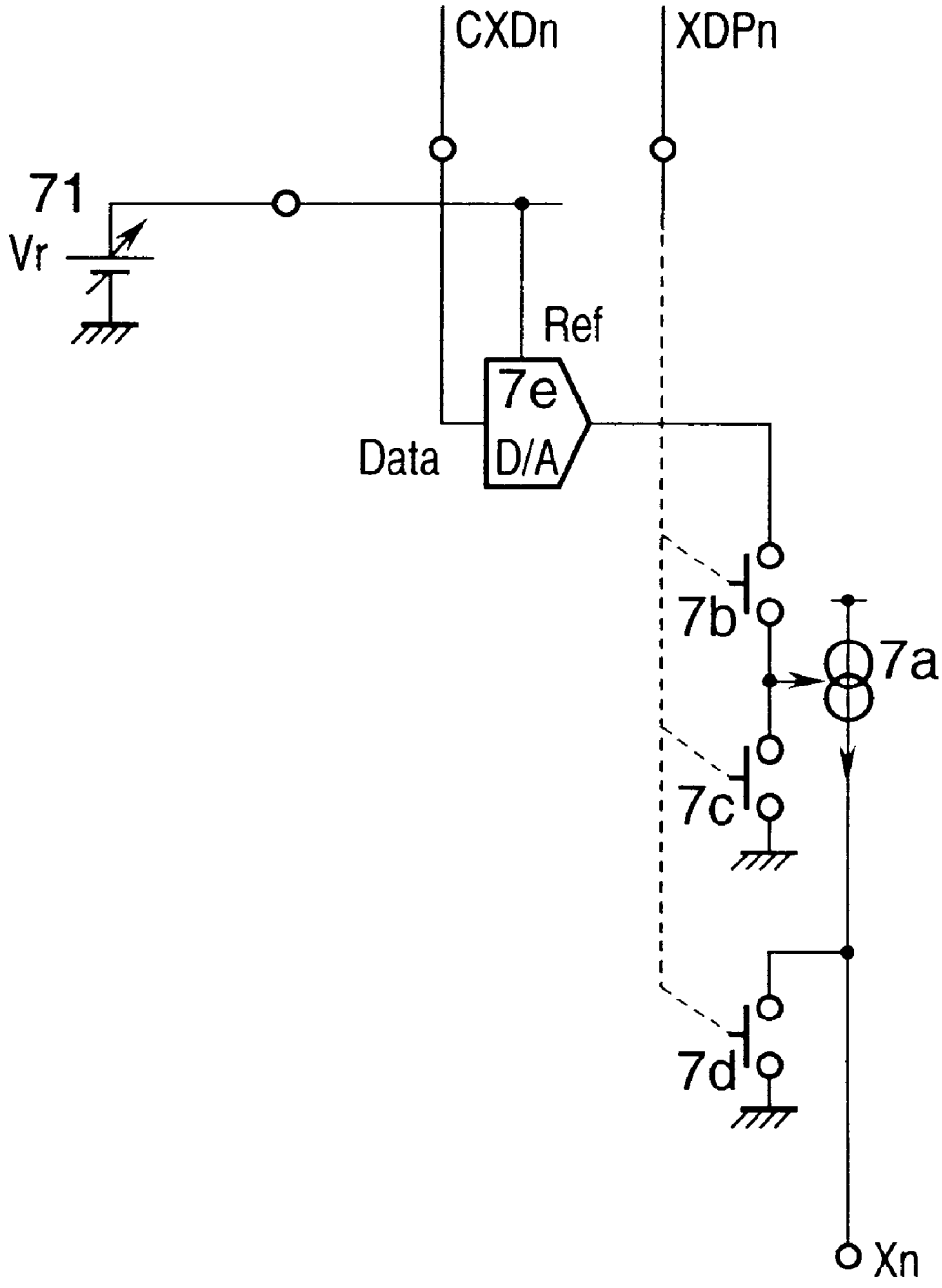
FIG. 9 is a circuit diagram showing another arrangement according to the third embodiment.

Similar to the second embodiment, the third embodiment can adopt an arrangement of switching the output voltage of the D/A converter by the switches 7*b* and 7*c* to reduce the power consumption of the current source, as shown in FIG. 9.

[Other Embodiment]

The first to third embodiments have exemplified the cold cathode type electron-emitting device, but an EL device or any other electron-emitting device can also be employed. For example, the cold cathode type electron source may be constituted by surface-conduction emission type electron-emitting devices, FE type electron-emitting devices, or MIM type electron-emitting devices.

The first to third embodiments have exemplified the image display apparatuses each using three, R, G, and B primary colors, but the image display apparatus may use, e.g., two, red and green colors. In this case, the power source 73 can be eliminated, and color adjustment can be done by setting the power sources 71 and 72 to desired voltages.

The image display apparatus according to each of the first to third embodiments basically comprises, in a low-profile airtight container, a multi electron source constituted by arranging many electron sources, e.g., many cold cathode devices on a substrate, and an image forming member for forming an image upon irradiation of electrons.

The cold cathode devices can be formed on a substrate at a high alignment precision using a manufacturing technique such as photolithography etching, so that many devices can be laid out at a small interval. The cold cathode device or its peripheral portion can be driven at a lower temperature than a thermionic cathode device conventionally used in a CRT and the like, and thus the cold cathode device can easily realize a multi electron source having a smaller layout pitch. This embodiment concerns an image forming apparatus using the above-described color cathode device as a multi electron source.

Of cold cathode devices, the surface-conduction emission type electron-emitting device (SCE) is especially preferable. That is, of cold cathode devices, the MIM type device must be relatively precisely controlled in the thicknesses of an insulating layer and upper electrode, and the FE type device must be precisely controlled in the distal end shape of a needle-like electron-emitting portion. For this reason, these devices are relatively high in manufacturing cost and are difficult to manufacture a large-area display owing to limitations on manufacturing process. To the contrary, the SCE has a simple structure, can be easily manufactured, and can easily realize a large-area display. Under recent circumstances where inexpensive, large-screen display apparatuses are required, the cold cathode device is especially preferable.

(Structure and Manufacturing Method of Display Panel)

The structure and manufacturing method of a display panel 1 of an image display apparatus according to the embodiment will be exemplified.

Figure 12:
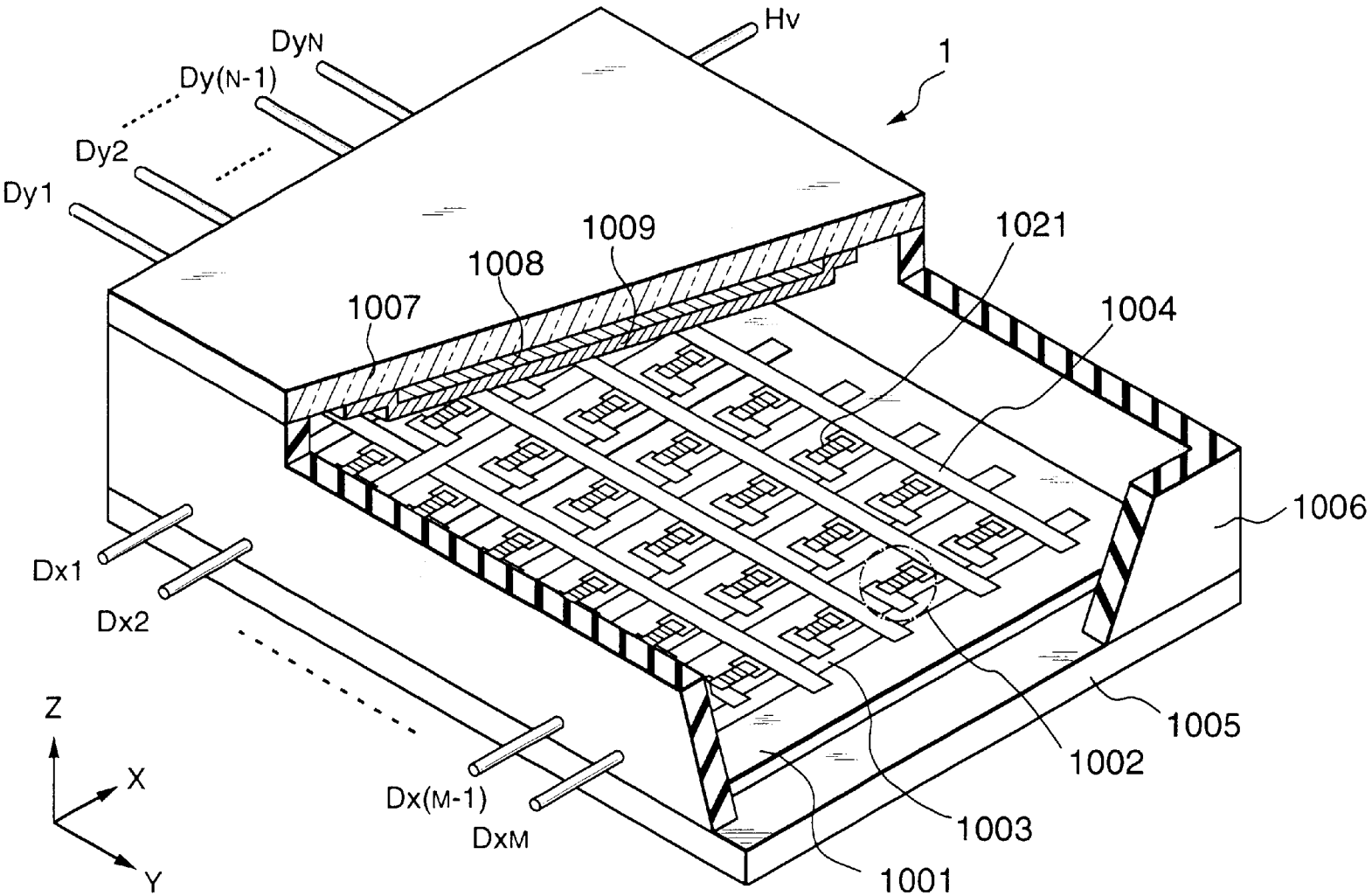
FIG. 12 is a partially cutaway perspective view of the display panel of the image display apparatus according to the embodiment.

FIG. 12 is a partially cutaway outer perspective view of the display panel 1 used in this embodiment showing the internal structure of the display panel 1.

In FIG. 12, reference numeral 1005 denotes a rear plate; 1006, a side wall; and 1007, a face plate. The rear plate 1005 to face plate 1007 constitute an airtight container for maintaining the inside of the display panel 1 vacuum. To construct the airtight container, it is necessary to seal-connect the respective parts to obtain sufficient strength and maintain airtight condition. For example, frit glass is applied to junction portions, and sintered at 400 to 500° C. in air or nitrogen atmosphere, thus the parts are seal-connected. A method for exhausting air from the inside of the container will be described later.

The rear plate 1005 has a substrate 1001 fixed thereon, on which N×M cold cathode devices 1002 are formed. In this case, both N and M are positive integers equal to 2 or more, and properly set in accordance with a desired number of display pixels. For example, in a display apparatus for high-resolution television display, N=3,000 or more, and M=1,000 or more are desirable. In this embodiment, N=480 or more, M=240. The N×M cold cathode devices 1002 are arranged in a simple matrix with M row-direction wirings 1003 and N column-direction wirings 1004. The structure constituted by the components denoted by the substrate 1001 to column-direction wiring 1004 will be referred to as a multi electron source. The manufacturing method and structure of the multi electron source will be described in detail later.

In this embodiment, the substrate 1001 of the multi electron source is fixed to the rear plate 1005 of the airtight container. If, however, the substrate 1001 of the multi electron source has sufficient strength, the substrate 1001 of the multi electron source may also serve as the rear plate of the airtight container.

Figure 13A:
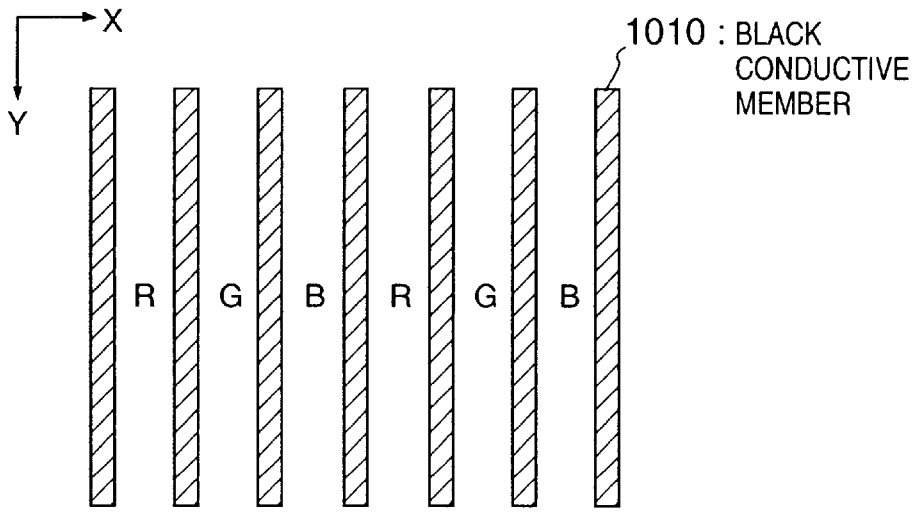
FIGS. 13A and 13B are plan views showing examples of the layout of fluorescent substances on the face plate of the display panel.

A fluorescent film 1008 is formed on the lower surface of the face plate 1007. As this embodiment concerns a color display apparatus, the fluorescent film 1008 is coated with red, green, and blue fluorescent substances, i.e., three primary color fluorescent substances used in the CRT field. As shown in FIG. 13A, fluorescent substances of the respective colors are formed into stripes, and black conductive members 1010 are provided between the stripes of the fluorescent substances. The purpose of providing the black conductive members 1010 is to prevent display color misregistration even if the irradiation position of an electron beam is shifted to some extent, to prevent degradation of display contrast by shutting off reflection of external light, to prevent the charge-up of the fluorescent film by an electron beam, and the like. As a material for the black conductive members 1010, graphite is used as a main component, but other materials may be used so long as the above purpose is attained.

Figure 13B:
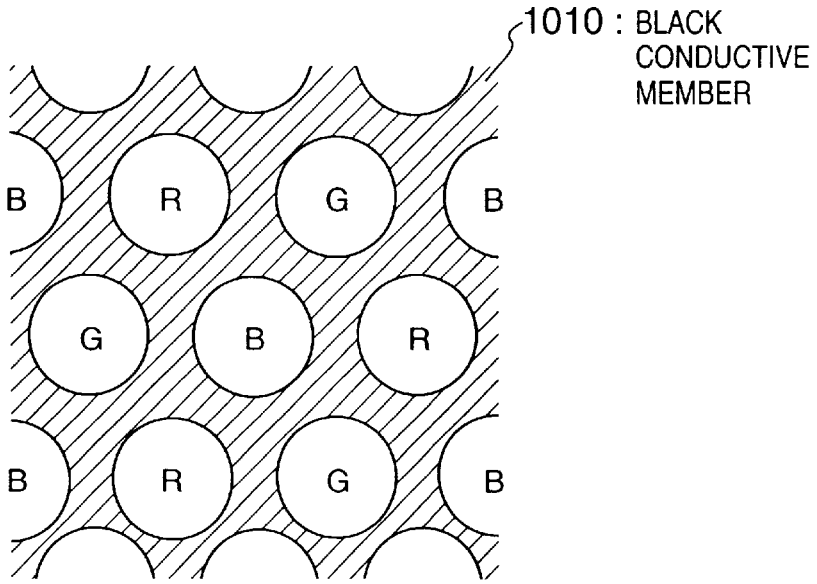

Further, the layout of fluorescent substances of the three primary colors is not limited to stripes as shown in FIG. 13A. For example, a delta layout as shown in FIG. 13B or any other layout may be employed. Note that when a monochrome display panel is to be formed, the fluorescent film 1008 may be made of a single-color fluorescent material, and the black conductive member may be omitted.

Furthermore, a metal back 1009, which is well-known in the CRT field, is provided on the fluorescent film 1008 on the rear plate side. The purpose of providing the metal back 1009 is to improve the light-utilization ratio by mirror-reflecting part of the light emitted by the fluorescent film 1008, to protect the fluorescent film 1008 from collision with negative ions, to be used as an electrode for applying an electron beam accelerating voltage, to be used as a conductive path for electrons which excited the fluorescent film 1008, and the like. The metal back 1009 is formed by forming the fluorescent film 1008 on the face plate substrate 1007, smoothing the front surface of the fluorescent film, and depositing Al (aluminum) thereon by vacuum deposition. Note that when the fluorescent film 1008 is made of fluorescent substances for a low voltage, the metal back 1009 is not used.

For application of an accelerating voltage or improvement of the conductivity of the fluorescent film, transparent electrodes made of ITO or the like may be provided between the face plate substrate 1007 and fluorescent film 1008, although such electrodes are not used in this embodiment.

Dx1 to DxM, Dy1 to DyN, and Hv are electric connection terminals for an airtight structure provided to electrically connect the display panel 1 to the above-described scanning driver 9 and modulated-signal driver 7. The row terminals Dx1 to DxM receive signals Y1 to Y240, and are connected to the row-direction wirings 1003 of the multi electron source. The column terminals Dy1 to DyN receive signals X1 to X480, and are connected to the column-direction wirings 1004 of the multi electron source. The terminal Hv is electrically connected to the metal back 1009 of the face plate.

To evacuate the airtight container, the airtight container is formed, then an exhaust pipe and vacuum pump (neither is shown) are connected, and the airtight container is evacuated to a vacuum of about $10^{-7}$ Torr. Thereafter, the exhaust pipe is sealed. To maintain the vacuum in the airtight container, a getter film (not shown) is formed at a predetermined position in the airtight container immediately before/after sealing. The getter film is formed by heating and evaporating a getter material mainly containing, e.g., Ba, by a heater or RF heating. The suction effect of the getter film maintains a vacuum of $1\times10^{-5}$ or $1\times10^{-7}$ Torr in the airtight container.

The basic structure and manufacturing method of the display panel 1 according to this embodiment have been briefly described above.

A method of manufacturing the multi electron source used in the display panel 1 of this embodiment will be described below. The multi electron source used in the image display apparatus of this embodiment is not particularly limited in the material, shape, and manufacturing method of the cold cathode device as long as the electron source is constituted by arranging cold cathode devices in a simple matrix. Therefore, cold cathode devices such as surface-conduction emission type electron-emitting devices, FE type devices, or MIM type devices can be used.

Under circumstances where inexpensive display apparatuses having large display areas are required, a surface-conduction emission type electron-emitting device, of these cold cathode devices, is especially preferable. More specifically, the electron-emitting characteristic of an FE type device is greatly influenced by the relative positions and shapes of the emitter cone and the gate electrode, and hence a high-precision manufacturing technique is required to manufacture this device. This poses a disadvantageous factor in attaining a large display area and a low manufacturing cost. According to an MIM type device, the thicknesses of the insulating layer and upper electrode must be decreased and made uniform. This also poses a disadvantageous factor in attaining a large display area and a low manufacturing cost. In contrast to this, a surface-conduction emission type electron-emitting device can be manufactured by a relatively simple manufacturing method, and hence an increase in display area and a decrease in manufacturing cost can be attained. The present inventors have found that among the surface-conduction emission type electron-emitting devices, an electron source having an electron-emitting portion or its peripheral portion made of a fine particle film is excellent in electron-emitting characteristic and can be easily manufactured. Such a device can therefore be most suitably used for the multi electron source of a high-brightness, large-screen image display apparatus. For this reason, the display panel 1 of this embodiment uses surface-conduction emission type electron-emitting devices each having an electron-emitting portion or its peripheral portion made of a fine particle film. The basic structure, manufacturing method, and characteristics of the preferred surface-conduction emission type electron-emitting device will be described first. Then, the structure of the multi electron source having many devices arranged in a simple matrix will be described.

(Preferred Structure and Manufacturing Method of Surface-Conduction Emission Type Electron-Emitting Device)

Typical examples of surface-conduction emission type electron-emitting devices each having an electron-emitting portion or its peripheral portion made of a fine particle film include two types of devices, namely flat and step type devices.

(Flat Surface-Conduction Emission Type Electron-Emitting Device)

First, the structure and manufacturing method of a flat surface-conduction emission type electron-emitting device will be described.

Figure 14A:
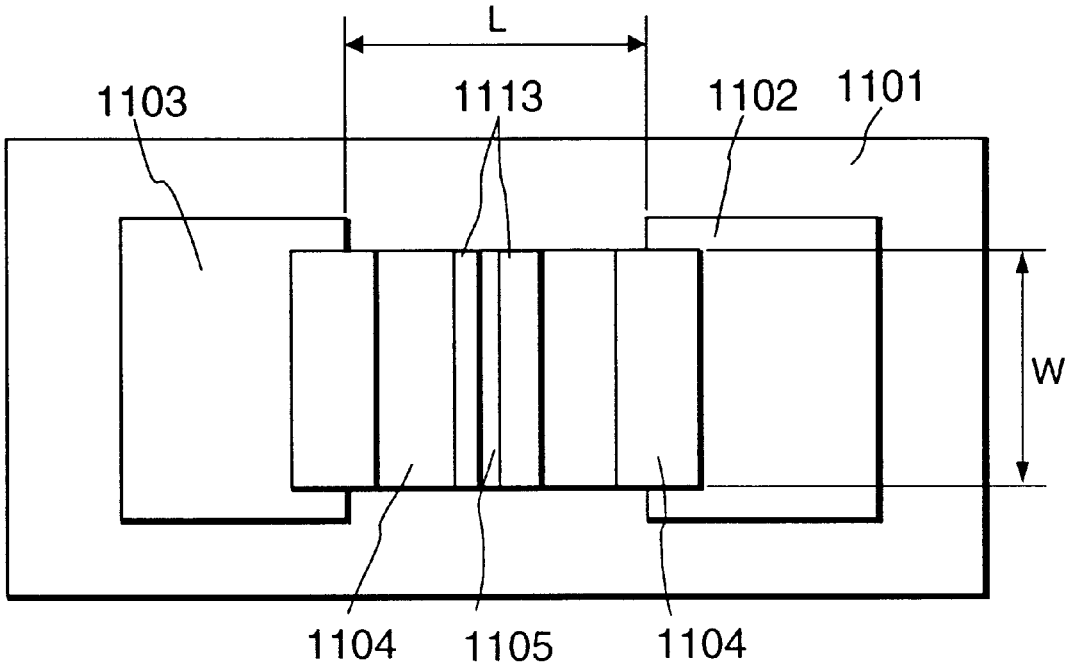
FIG. 14A is a plan view showing a flat surface-conduction emission type electron-emitting device used in this embodiment.
Figure 14B:
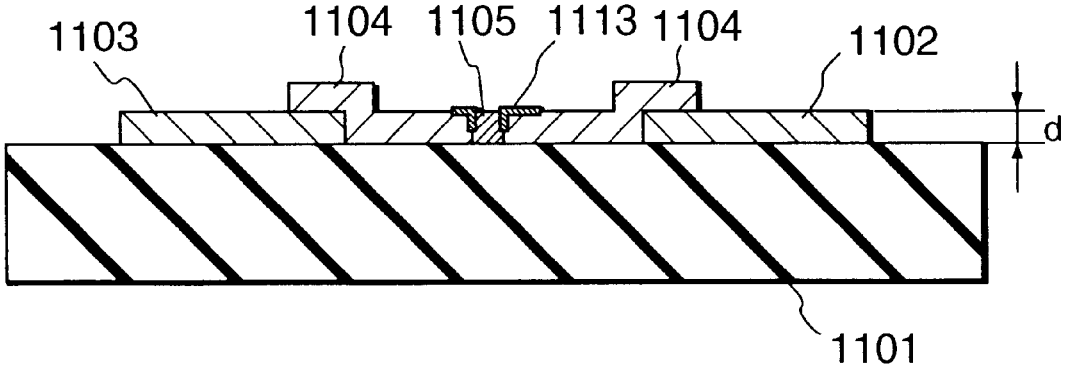
FIG. 14B is a sectional view thereof.

FIG. 14A is a plan view for explaining the structure of the flat surface-conduction emission type electron-emitting device, and FIG. 14B is a sectional view thereof. Referring to FIGS. 14A and 14B, reference numeral 1101 denotes a substrate; 1102 and 1103, device electrodes; 1104, a conductive thin film; 1105, an electron-emitting portion formed by forming processing; and 1113, a thin film formed by activation processing.

As the substrate 1101, various glass substrates of, e.g., quartz glass and soda-lime glass, various ceramic substrates of, e.g., alumina, or any of those substrates with, e.g., an $SiO_2$ insulating layer formed thereon can be employed. The device electrodes 1102 and 1103, provided in parallel to the substrate 1101 and opposing to each other, comprise conductive material. For example, any material of metals such as Ni, Cr, Au, Mo, W, Pt, Ti, Cu, Pd and Ag, or alloys of these metals, otherwise metal oxides such as $In_2O_3$—$SnO_2$, or semiconductive material such as polysilicon, can be employed. These electrodes 1102 and 1103 can be easily formed by the combination of a film-forming technique such as vacuum-evaporation and a patterning technique such as photolithography or etching, however, any other method (e.g., printing technique) may be employed.

The shape of the electrodes 1102 and 1103 is appropriately designed in accordance with an application object of the electron-emitting device. Generally, an interval L between electrodes is designed by selecting an appropriate value in a range from hundred Å to hundred $\mu$m. Most preferable range for a display apparatus is from several $\mu$m to ten $\mu$m. As for electrode thickness d, an appropriate value is selected in a range from hundred Å to several $\mu$m.

The conductive thin film 1104 comprises a fine particle film. The "fine particle film" is a film which contains a lot of fine particles (including masses of particles) as film-constituting members. In microscopic view, normally individual particles exist in the film at predetermined intervals, or in adjacent to each other, or overlapped with each other.

One particle of the fine particle film has a diameter within a range from several Å to thousand Å. Preferably, the diameter is within a range from 10 Å to 200 Å. The thickness of the fine particle film is appropriately set in consideration of conditions as follows. That is, condition necessary for electrical connection to the device electrode 1102 or 1103, condition for forming processing to be described later, condition for setting electrical resistance of the fine particle film itself to an appropriate value to be described later etc. Specifically, the thickness of the film is set in a range from several Å to thousand Å, more preferably, 10 Å to 500 Å.

Materials used for forming the fine particle film are, e.g., metals such as Pd, Pt, Ru, Ag, Au, Ti, In, Cu, Cr, Fe, Zn, Sn, Ta, W, and Pb, oxides such as PdO, $SnO_2$, $In_2O_3$, PbO, and $Sb_2O_3$, borides such as $HfB_2$, $ZrB_2$, $LaB_6$, $CeB_6$, $YB_4$ and, $GdB_4$, carbides such as TiC, ZrC, HfC, TaC, SiC, and WC, nitrides such as TiN, ZrN, and HfN, semiconductors such as Si and Ge, and carbons. Any of appropriate material(s) is appropriately selected.

As described above, the conductive thin film 1104 is formed with a fine particle film, and sheet resistance of the film is set to reside within a range from $10^3$ to $10^7$ (Ω/sq).

As it is preferable that the conductive thin film 1104 is electrically connected to the device electrodes 1102 and 1103, they are arranged so as to overlap with each other at one portion. In FIGS. 14A and 14B, the respective parts are overlapped in order of, the substrate, the device electrodes, and the conductive thin film, from the bottom. This overlapping order may be, the substrate, the conductive thin film, and the device electrodes, from the bottom. The electron-emitting portion 1105 is a fissured portion formed at part of the conductive thin film 1104. The electron-emitting portion 1105 has a resistance characteristic higher than peripheral conductive thin film. The fissure is formed by forming processing to be described later on the conductive thin film 1104. In some cases, particles, having a diameter of several Å to hundred Å, are arranged within the fissured portion. As it is difficult to exactly illustrate actual position and shape of the electron-emitting portion, therefore, FIGS. 14A and 14B show the fissured portion schematically.

The thin film 1113, which comprises carbon or carbon compound material, covers the electron-emitting portion 1115 and its peripheral portion. The thin film 1113 is formed by activation processing to be described later after forming processing. The thin film 1113 is preferably graphite monocrystalline, graphite polycrystalline, amorphous carbon, or mixture thereof, and its thickness is 500 Å or less, more preferably, 300 Å or less.

As it is difficult to exactly illustrate actual position or shape of the thin film 1113, FIGS. 14A and 14B show the film schematically. FIG. 14A shows the device where part of the thin film 1113 is removed.

The preferred basic structure of the device is described above. In this embodiment, the device has the following constituents.

That is, the substrate 1101 comprises a soda-lime glass, and the device electrodes 1102 and 1103, an Ni thin film. The electrode thickness d is 1,000 Å and the electrode interval L is 2 $\mu$m. The main material of the fine particle film is Pd or PdO. The thickness of the fine particle film is about 100 Å, and its width W is 100 $\mu$m.

Next, a method of manufacturing a preferred flat surface-conduction emission type electron-emitting device will be described.

FIGS. 15A to 15E are sectional views for explaining the manufacturing processes of the surface-conduction emission type electron-emitting device according to this embodiment. Note that reference numerals are the same as those in FIGS. 14A and 14B.

Figure 15A:
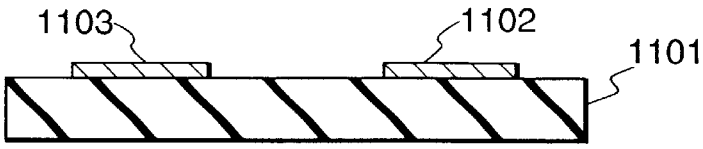
FIGS. 15A to 15E are sectional views for explaining the steps in manufacturing the flat surface-conduction emission type electron-emitting device.

(1) First, as shown in FIG. 15A, the device electrodes 1102 and 1103 are formed on the substrate 1101. In forming these electrodes 1102 and 1103, first, the substrate 1101 is fully washed with a detergent, pure water and an organic solvent, then, material of the device electrodes is deposited there. As a depositing method, a vacuum film-forming technique such as evaporation and sputtering may be used. Thereafter, patterning using a photolithography etching technique is performed on the deposited electrode material. Thus, the pair of device electrodes (1102 and 1103) shown in FIG. 15A are formed.

Figure 15B:
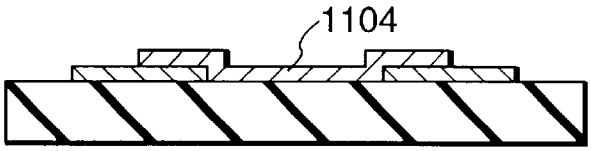

(2) Next, as shown in FIG. 15B, the conductive thin film 1104 is formed. In forming the conductive thin film 1104, first, an organic metal solvent is applied to the substrate, then the applied solvent is dried and sintered, thus forming a fine particle film. Thereafter, the fine particle film is patterned into a predetermined shape by the photolithography etching method. The organic metal solvent means a solvent of organic metal compound containing material of fine particles, used for forming the conductive thin film, as a main element. (More specifically, Pd is used as a main element in this embodiment. In this embodiment, application of organic metal solvent is made by dipping, however, any other method such as a spinner method and spraying method may be employed.) As a film-forming method of the conductive thin film made with the fine particle film, application of organic metal solvent used in this embodiment can be replaced with any other method such as a vacuum evaporation method, a sputtering method or a chemical vapor-phase accumulation method.

Figure 15C:
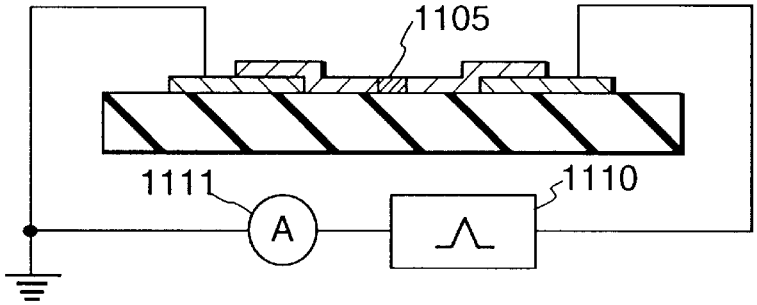

(3) Then, as shown in FIG. 15C, an appropriate voltage is applied between the device electrodes 1102 and 1103, from a power source 1110 for forming processing, then forming processing is performed, thus forming the electron-emitting portion 1105. The forming processing here is electric energization of a conductive thin film 1104 made of a fine particle film to appropriately destroy, deform, or deteriorate part of the conductive thin film, thus changing the film to have a structure suitable for electron emission. Of the conductive thin film made of the fine particle film, the portion changed for electron emission (i.e., electron-emitting portion 1105) has an appropriate fissure in the thin film. Comparing the thin film 1104 having the electron-emitting portion 1105 with the thin film before forming processing, the electrical resistance measured between the device electrodes 1102 and 1103 has greatly increased.

Figure 16:
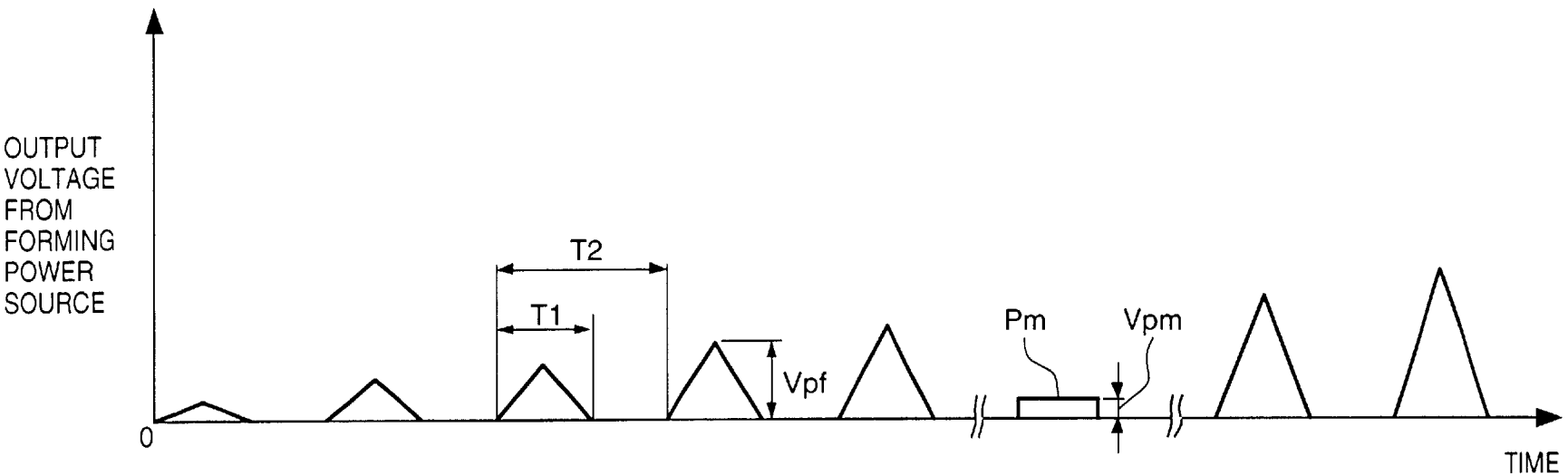
FIG. 16 is a graph showing the application voltage waveform in forming processing.

The electrification method will be explained in more detail with reference to FIG. 16 showing an example of waveform of appropriate voltage applied from the forming power source 1110. Preferably, in case of forming a conductive thin film of a fine particle film, a pulse-like voltage is employed. In this embodiment, as shown in FIG. 16, a triangular-wave pulse having a pulse width T1 is continuously applied at pulse interval of T2. Upon application, a peak value Vpf of the triangular-wave pulse is sequentially increased. Further, a monitor pulse Pm to monitor status of forming the electron-emitting portion 1105 is inserted between the triangular-wave pulses at appropriate intervals, and current that flows at the insertion is measured by a galvanometer 1111.

In this embodiment, in $10^{-5}$ Torr vacuum atmosphere, the pulse width T1 is set to 1 msec; and the pulse interval T2, to 10 msec. The peak value Vpf is increased by 0.1 V, at each pulse. Each time the triangular-wave has been applied for five pulses, the monitor pulse Pm is inserted. To avoid ill-effecting forming processing, a voltage Vpm of the monitor pulse is set to 0.1 V. When the electrical resistance between the device electrodes 1102 and 1103 becomes $1\times10^{6}\Omega$, i.e., the current measured by the galvanometer 1111 upon application of monitor pulse becomes $1\times10^{-7}$ A or less, the electrification of forming processing is terminated.

Note that the above processing method is preferable to the surface-conduction emission type electron-emitting device of this embodiment. In case of changing the design of the surface-conduction emission type electron-emitting device concerning, e.g., the material or thickness of the fine particle film, or the device electrode interval L, the conditions for electrification are preferably changed in accordance with the change of device design.

Figure 15D:
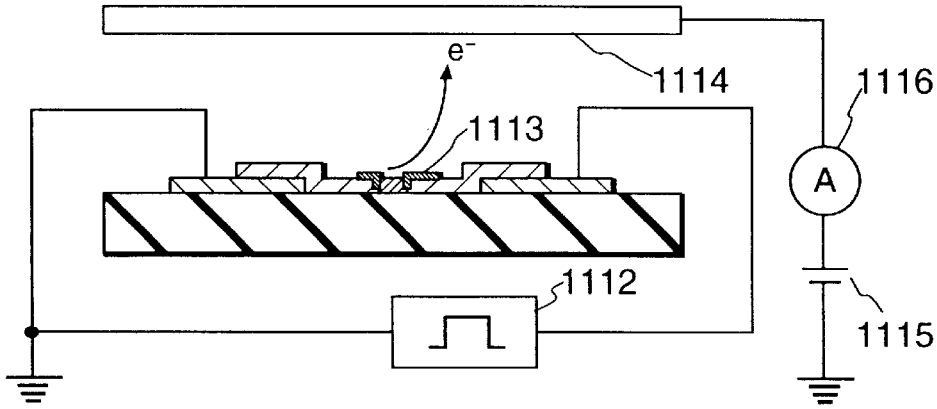

(4) Next, as shown in FIG. 15D, appropriate voltage is applied, from an activation power source 1112, between the device electrodes 1102 and 1103, and activation processing is performed to improve electron-emitting characteristic. The activation processing here is electrification of the electron-emitting portion 1105 formed by forming processing, on appropriate condition(s), for depositing carbon or carbon compound around the electron-emitting portion 1105. (In FIG. 15D, the deposited material of carbon or carbon compound is shown as material 1113.) Comparing the electron-emitting portion 1105 with that before activation processing, the emission current at the same application voltage has become, typically 100 times or greater.

Activation is made by periodically applying a voltage pulse in $10^{-4}$ or $10^{-5}$ Torr vacuum atmosphere, to accumulate carbon or carbon compound mainly derived from organic compound(s) existing in the vacuum atmosphere. The accumulated material 1113 is any of graphite monocrystalline, graphite polycrystalline, amorphous carbon or mixture thereof. The thickness of the accumulated material 1113 is 500 Å or less, more preferably, 300 Å or less.

Figure 17A:
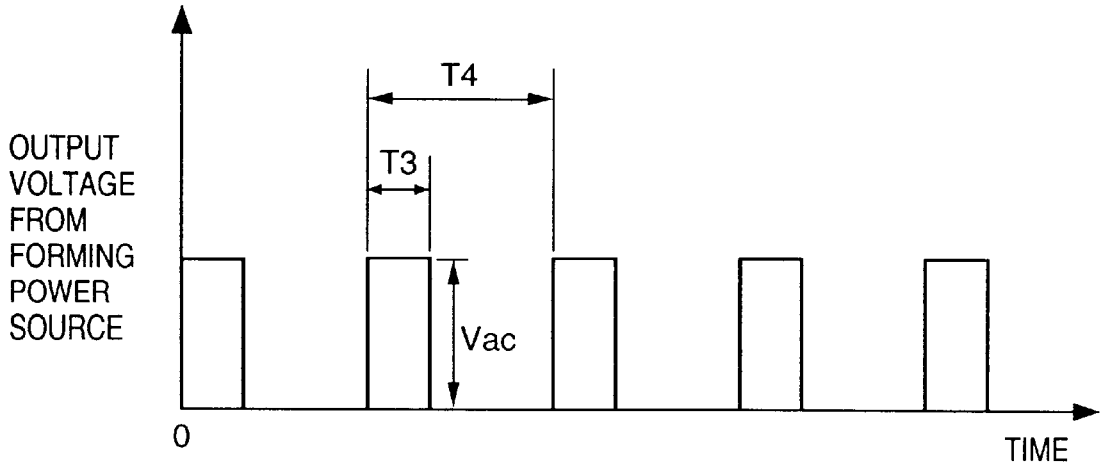
FIG. 17A is a graph showing the application voltage waveform in activation processing.

The electrification method will be described in more detail with reference to FIG. 17A showing an example of waveform of appropriate voltage applied from the activation power source 1112. In this embodiment, activation processing is performed by periodically applying a rectangular wave at a predetermined voltage. A rectangular-wave voltage Vac is set to 14 V; a pulse width T3, to 1 msec; and a pulse interval T4, to 10 msec. Note that the above electrification conditions are preferable for the surface-conduction emission type electron-emitting device of this embodiment. In the case in which the design of the surface-conduction emission type electron-emitting device is changed, the electrification conditions are preferably changed in accordance with the change of device design.

Figure 17B:
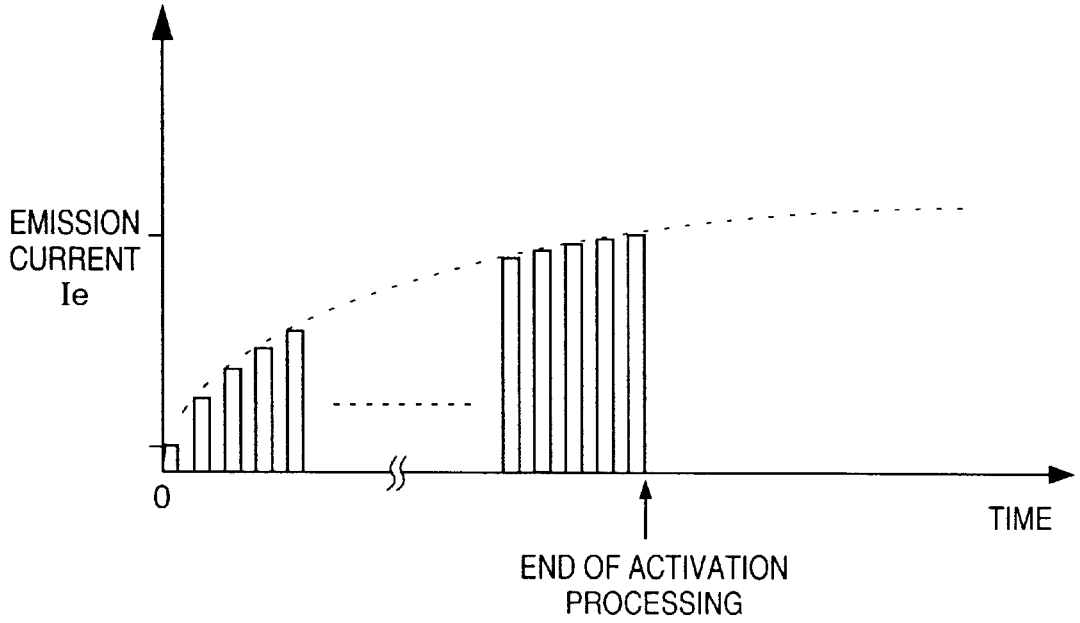
FIG. 17B is a graph showing changes in emission current Ie.

In FIG. 15D, reference numeral 1114 denotes an anode electrode, connected to a DC high-voltage power source 1115 and galvanometer 1116, for capturing emission current Ie emitted from the surface-conduction emission type electron-emitting device. (In the case in which the substrate 1101 is incorporated into the display panel before activation processing, the fluorescent surface of the display panel is used as the anode electrode 1114.) While applying voltage from the activation power source 1112, the galvanometer 1116 measures the emission current Ie, thus monitors the progress of activation processing, to control the operation of the activation power source 1112. FIG. 17B shows an example of the emission current Ie measured by the galvanometer 1116. As application of pulse voltage from the activation power source 1112 is started in this manner, the emission current Ie increases with elapse of time, gradually comes into saturation, and almost never increases then. At the substantial saturation point, the voltage application from the activation power source 1112 is stopped, then activation processing is terminated.

Note that the above electrification conditions are preferable to the surface-conduction emission type electron-emitting device of this embodiment. In case of changing the design of the surface-conduction emission type electron-emitting device, the conditions are preferably changed in accordance with the change of device design.

Figure 15E:
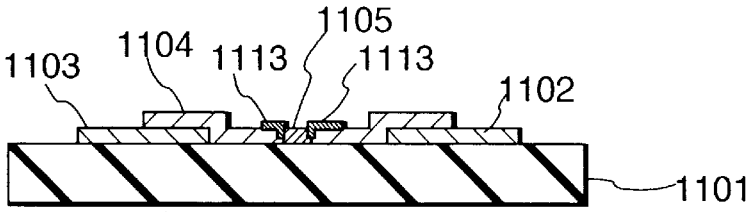

As described above, the surface-conduction emission type electron-emitting device as shown in FIG. 15E is manufactured.

(Step Surface-Conduction Emission Type Electron-Emitting Device)

Next, another typical structure of the surface-conduction emission type electron-emitting device where an electron-emitting portion or its peripheral portion is formed of a fine particle film, i.e., a stepped surface-conduction emission type electron-emitting device will be described.

Figure 18:
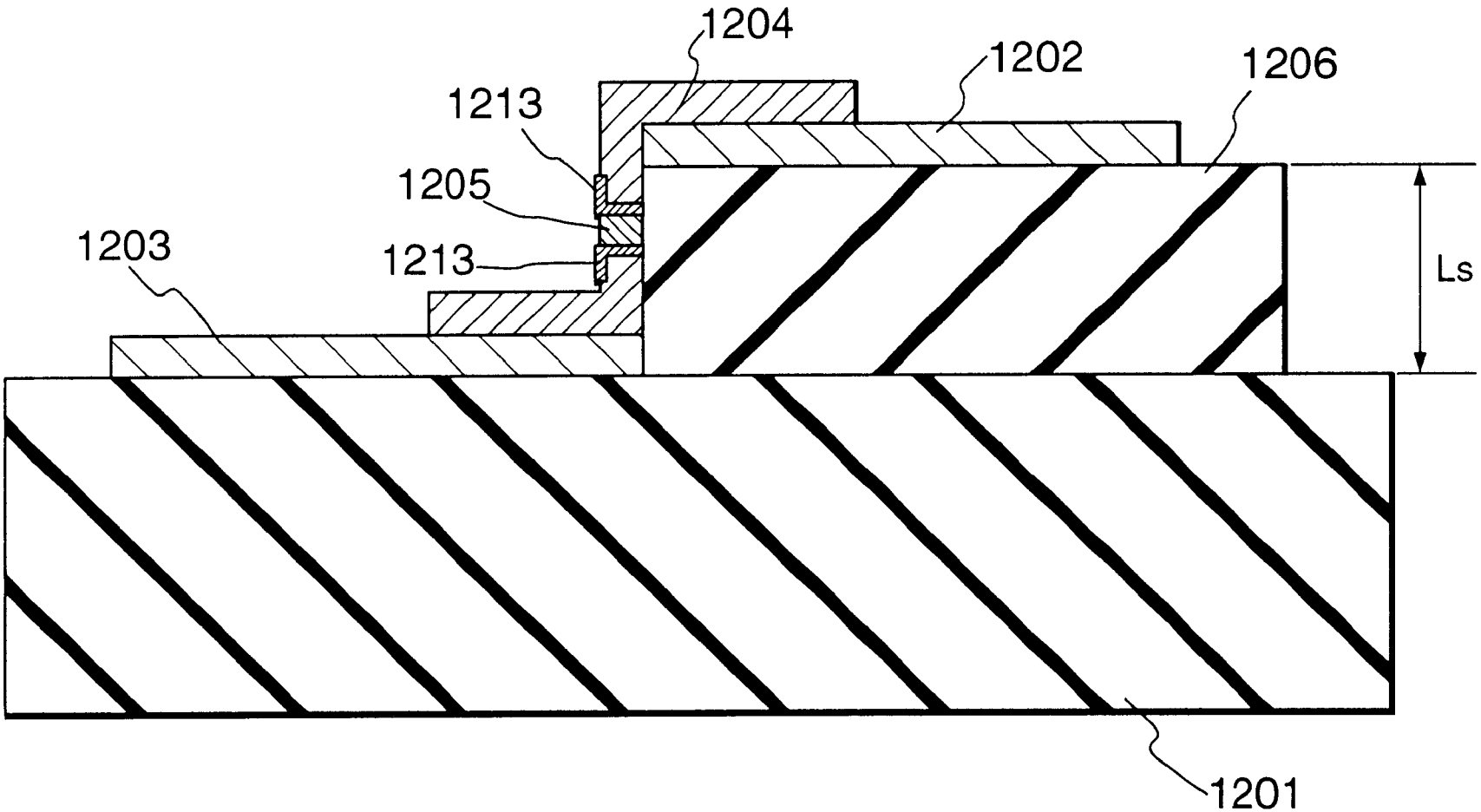
FIG. 18 is a sectional view showing a step surface-conduction emission type electron-emitting device used in the embodiment.

FIG. 18 is a sectional view schematically showing the basic construction of the step surface-conduction emission type electron-emitting device. Referring to FIG. 18, reference numeral 1201 denotes a substrate; 1202 and 1203, device electrodes; 1206, a step-forming member for making height difference between the electrodes 1202 and 1203; 1204, a conductive thin film using a fine particle film; 1205, an electron-emitting portion formed by forming processing; and 1213, a thin film formed by activation processing.

Difference between the step device from the above-described flat device is that one of the device electrodes (1202) is provided on the step-forming member 1206 and the conductive thin film 1204 covers the side surface of the step-forming member 1206. The device interval L in FIG. 14A is set in this structure as a height difference Ls corresponding to the height of the step-forming member 1206. Note that the substrate 1201, device electrodes 1202 and 1203, conductive thin film 1204 using the fine particle film can comprise the materials given in the explanation of the flat surface-conduction emission type electron-emitting device. Further, the step-forming member 1206 comprises electrically insulating material such as $SiO_2$.

Next, a method of manufacturing the stepped surface-conduction emission type electron-emitting device will be described.

FIGS. 19A to 19F are sectional views showing the manufacturing processes. In these figures, reference numerals of the respective parts are the same as those in FIG. 18.

Figure 19A:
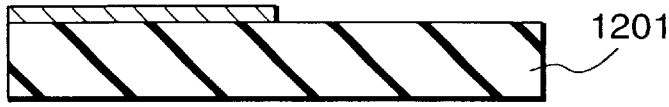
FIGS. 19A to 19F are sectional views showing the steps in manufacturing the step surface-conduction emission type electron-emitting device.

(1) First, as shown in FIG. 19A, the device electrode 1203 is formed on the substrate 1201.

Figure 19B:
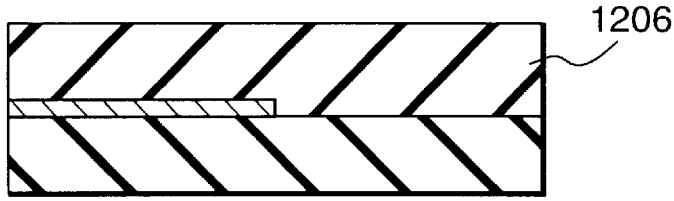

(2) Next, as shown in FIG. 19B, an insulating layer for forming the step-forming member is deposited. The insulating layer may be formed by accumulating, e.g., $SiO_2$ by a sputtering method, however, the insulating layer may be formed by a film-forming method such as a vacuum evaporation method or a printing method.

Figure 19C:
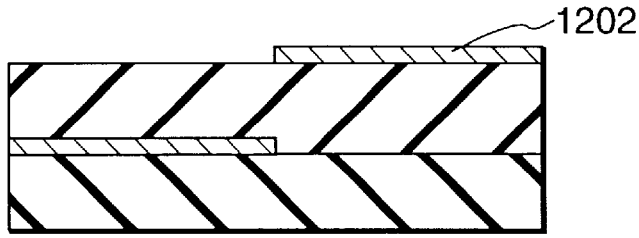

(3) Next, as shown in FIG. 19C, the device electrode 1202 is formed on the insulating layer.

Figure 19D:
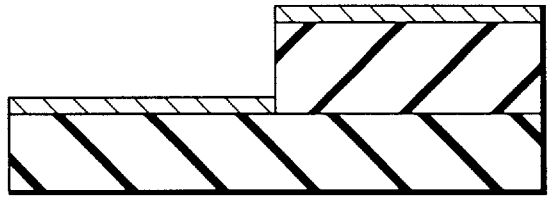

(4) Next, as shown in FIG. 19D, part of the insulating layer is removed by using, e.g., an etching method, to expose the device electrode 1203.

Figure 19E:
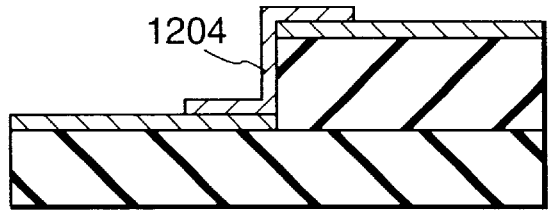

(5) Next, as shown in FIG. 19E, the conductive thin film 1204 using the fine particle film is formed. Upon formation, similar to the above-described flat device structure, a film-forming technique such as an applying method is used.

(6) Next, similar to the flat device structure, forming processing is performed to form an electron-emitting portion. (Forming processing similar to that explained using FIG. 15C may be performed.)

(7) Next, similar to the flat device structure, activation processing is performed to deposit carbon or carbon compound around the electron-emitting portion.

(Activation Processing Similar to that Explained using FIG. 15D may be Performed)

Figure 19F:
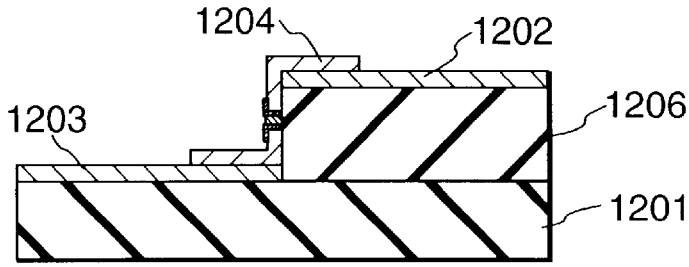

As described above, the stepped surface-conduction emission type electron-emitting device shown in FIG. 19F is manufactured.

(Characteristic of Surface-Conduction Emission Type Electron-Emitting Device Used in Display Apparatus)

The structure and manufacturing method of the flat surface-conduction emission type electron-emitting device and those of the stepped surface-conduction emission type electron-emitting device are as described above. Next, the characteristic of the electron-emitting device used in the display apparatus will be described below.

Figure 20:
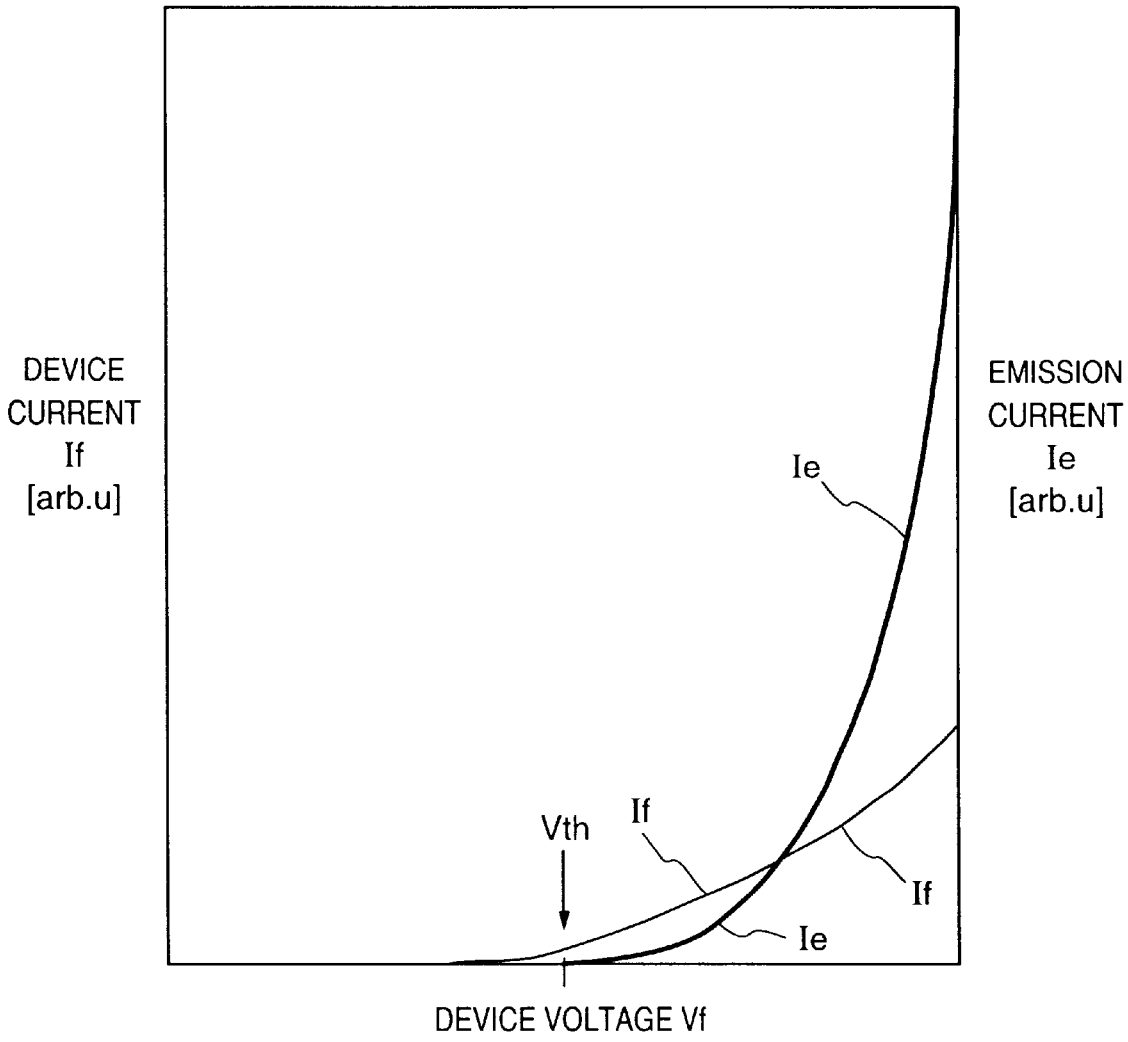
FIG. 20 is a graph showing the typical characteristics of the surface-conduction emission type electron-emitting device in the embodiment.

FIG. 20 shows a typical example of (emission current Ie) to (device application voltage Vf) characteristic and (device current If) to (device application voltage Vf) characteristic of the device used in the display apparatus. Note that compared with the device current If, the emission current Ie is very small, therefore it is difficult to illustrate the emission current Ie by the same measure of that for the device current If. In addition, these characteristics change due to change of designing parameters such as the size or shape of the device. For these reasons, two lines in the graph of FIG. 20 are respectively given in arbitrary units.

Regarding the emission current Ie, the device used in the display apparatus has three characteristics as follows:

First, when voltage of a predetermined level (referred to as "threshold voltage Vth") or greater is applied to the device, the emission current Ie drastically increases, however, with voltage lower than the threshold voltage Vth, almost no emission current Ie is detected. That is, regarding the emission current Ie, the device has a nonlinear characteristic based on the clear threshold voltage Vth.

Second, the emission current Ie changes in dependence upon the device application voltage Vf. Accordingly, the emission current Ie can be controlled by changing the device voltage Vf.

Third, the current Ie is output quickly in response to application of the device voltage Vf to the device. Accordingly, an electrical charge amount of electrons to be emitted from the device can be controlled by changing period of application of the device voltage Vf.

The surface-conduction emission type electron-emitting device with the above three characteristics is preferably applied to the display apparatus. For example, in a display apparatus having a large number of devices provided corresponding to the number of pixels of a display screen, if the first characteristic is utilized, display by sequential scanning of display screen is possible. This means that the threshold voltage Vth or greater is appropriately applied to a driven device in accordance with a desired emission luminance, while voltage lower than the threshold voltage Vth is applied to an unselected device. In this manner, sequentially changing the driven devices enables display by sequential scanning of display screen. Further, emission luminance can be controlled by utilizing the second or third characteristic, which enables multi-gradation display.

(Structure of Multi Electron Source With Many Devices Arranged in Simple Matrix)

Next, the structure of the multi electron source having the above-described surface-conduction emission type electron-emitting devices arranged on the substrate in a simple matrix will be described below.

Figure 21:
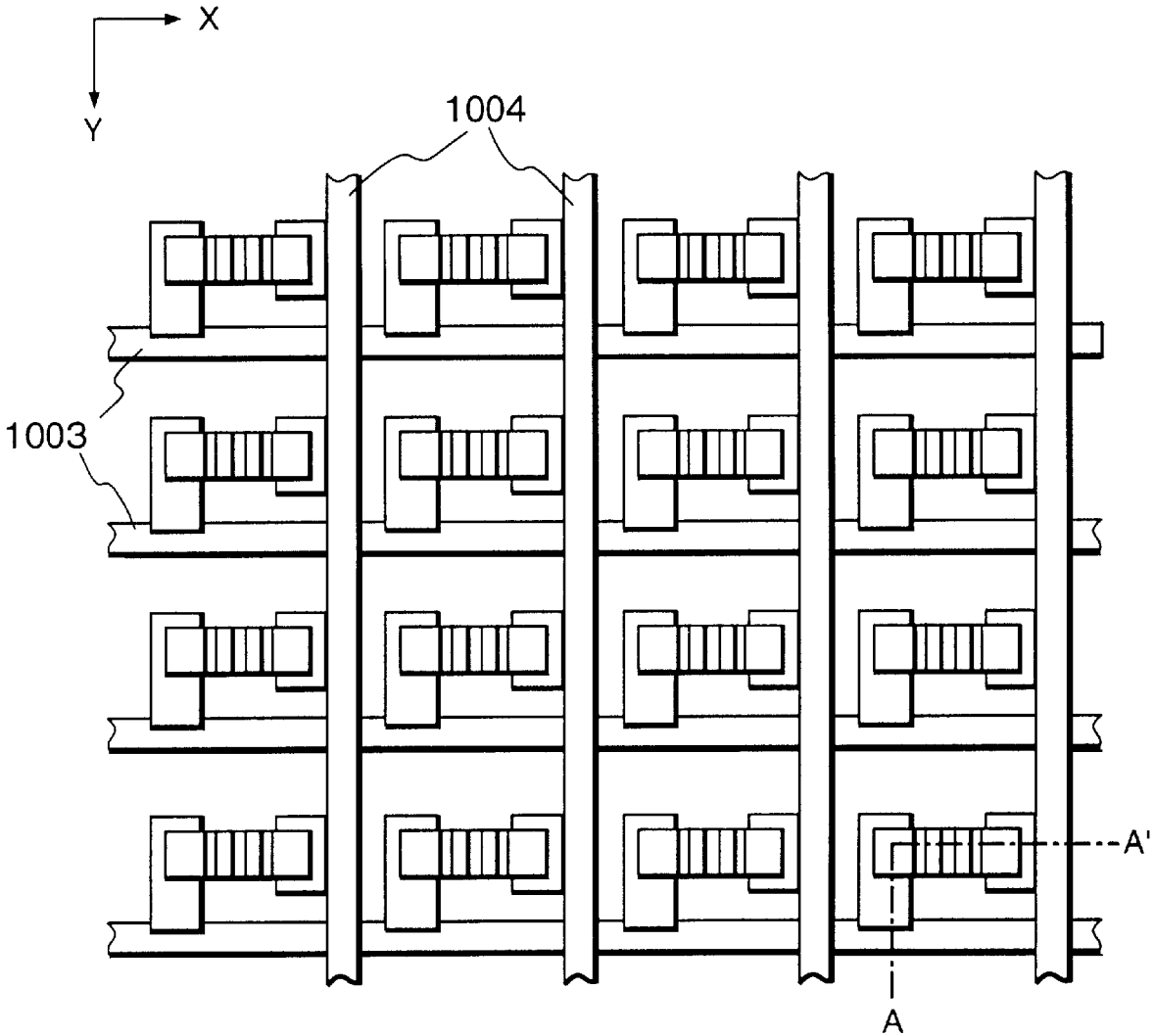
FIG. 21 is a plan view showing the substrate of a multi electron source used in the embodiment.

FIG. 21 is a plan view of the multi electron source used in the display panel 1 in FIG. 12. There are surface-conduction emission type electron-emitting devices like the one shown in FIGS. 14A and 14B on the substrate. These devices are arranged in a simple matrix with the row- and column-direction wirings 1003 and 1004. At an intersection of the row- and column-direction wirings 1003 and 1004, an insulating layer (not shown) is formed between the wires, to maintain electrical insulation.

Figure 22:
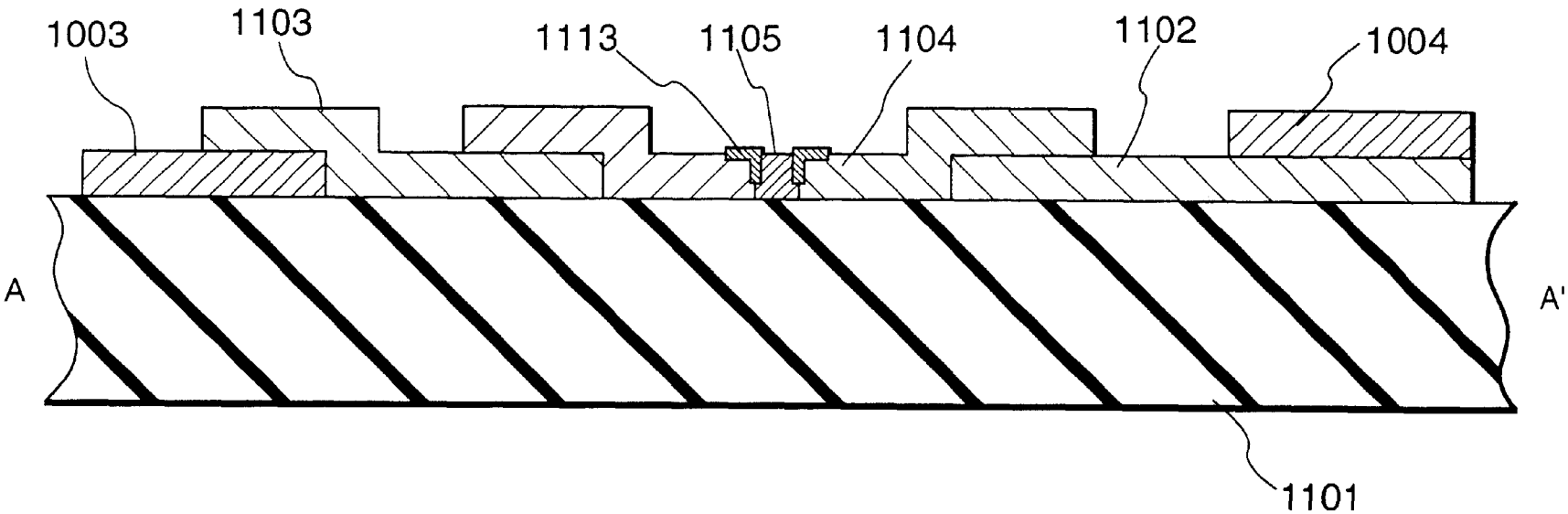
FIG. 22 is a partial sectional view showing the substrate of the multi electron source used in the embodiment.
Figure 24:
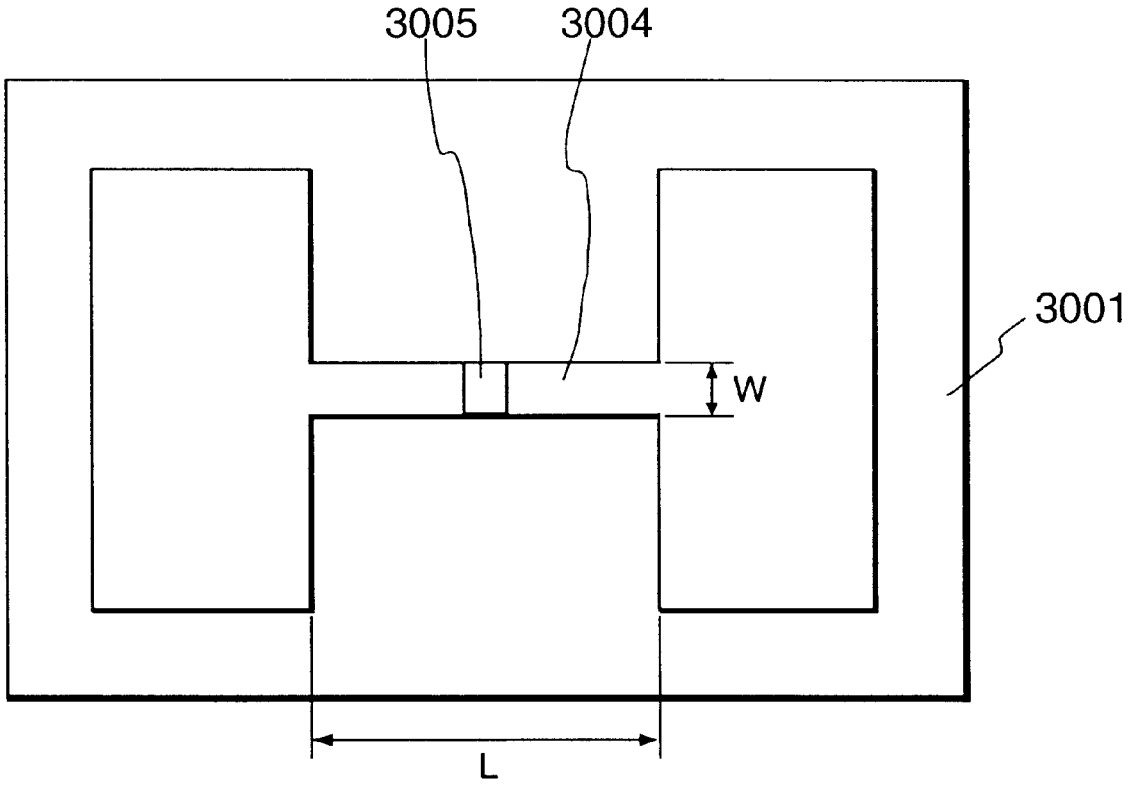
FIG. 24 is a plan view for explaining a conventional electron-emitting device.
Figure 25:
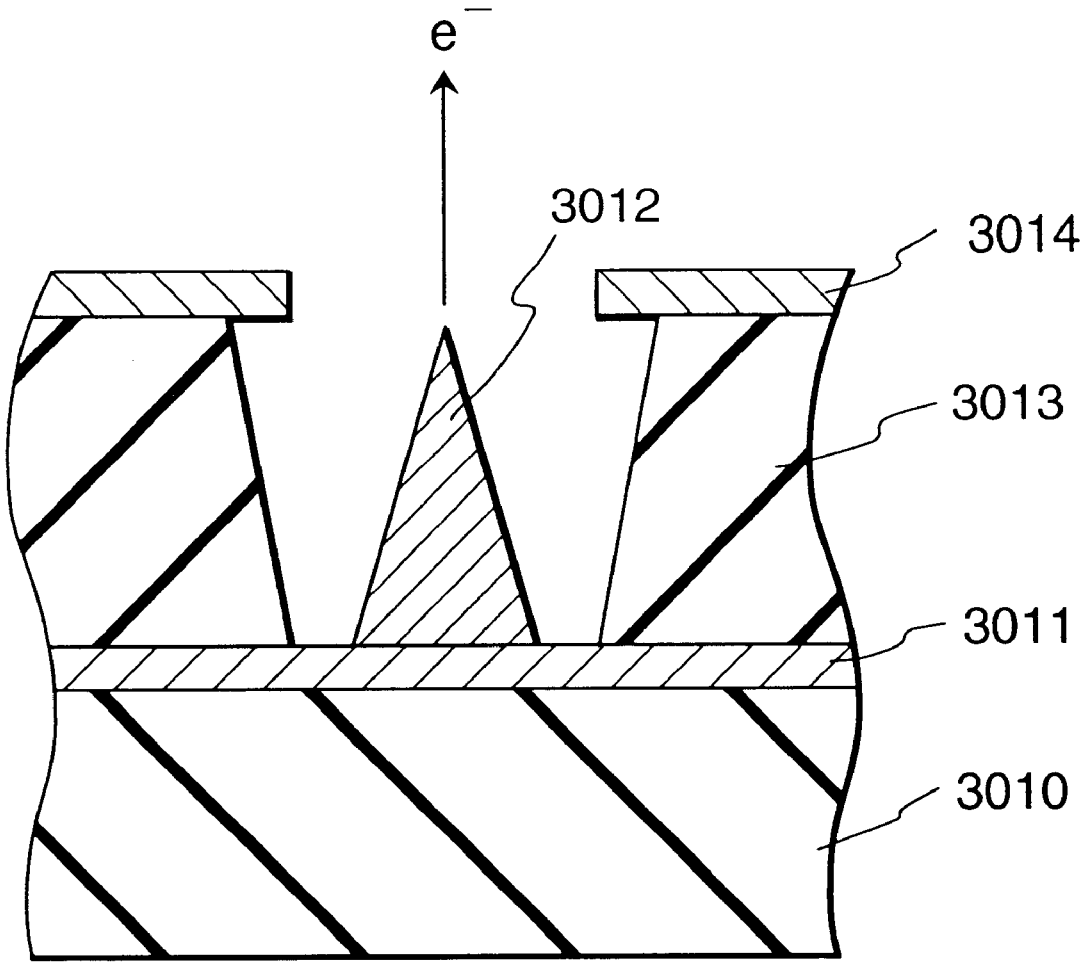
FIG. 25 is a sectional view for explaining another conventional electron-emitting device.
Figure 26:
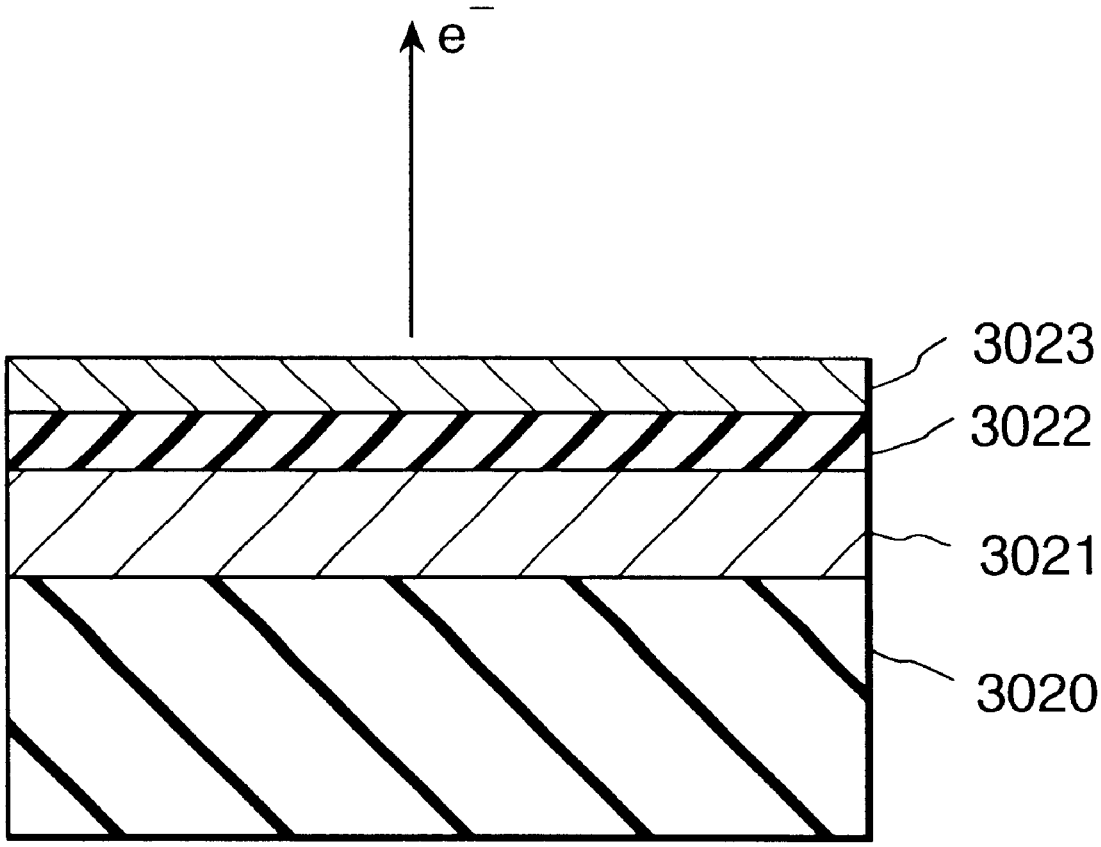
FIG. 26 is a sectional view for explaining still another conventional electron-emitting device.
Figure 27:
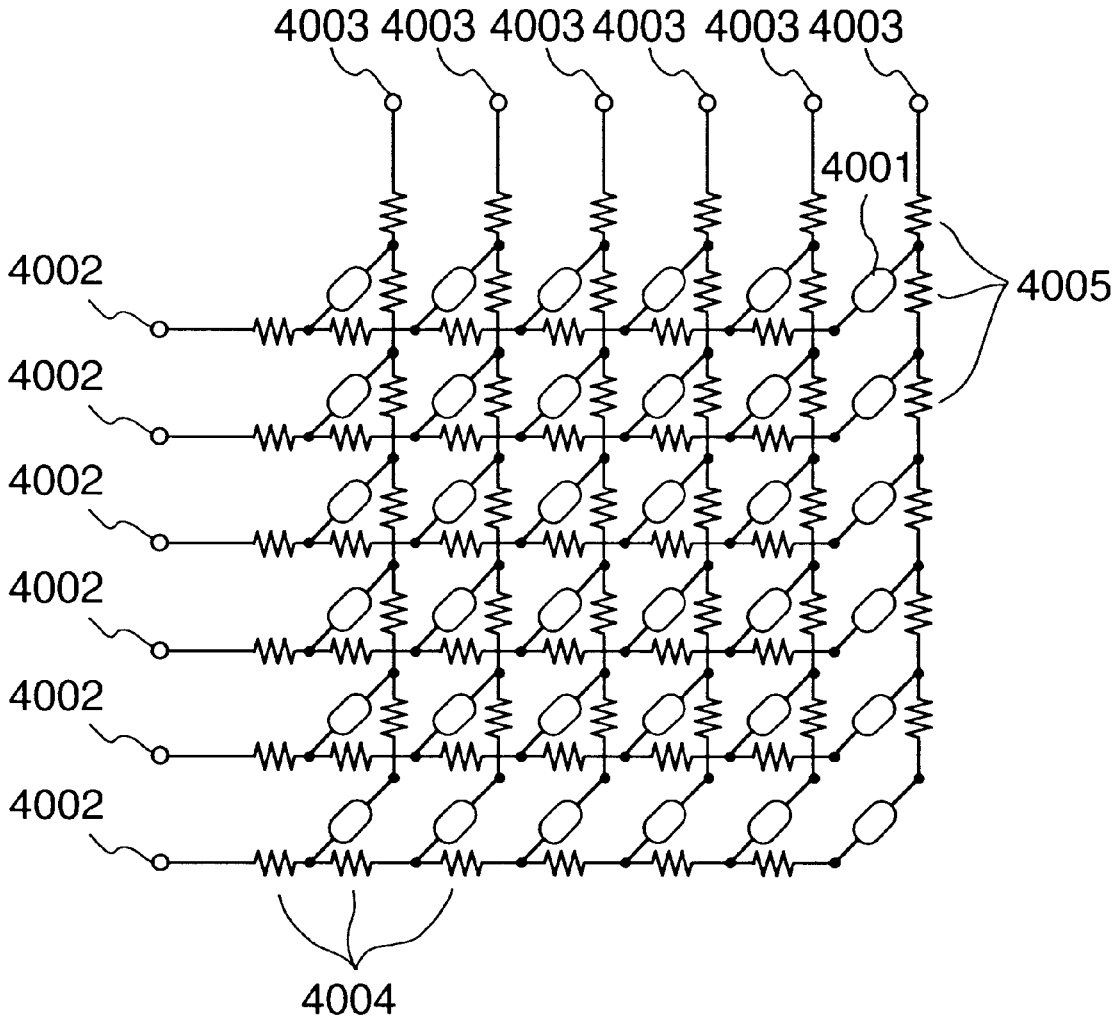
FIG. 27 is a diagram for explaining a conventional electron-emitting device wiring method.

FIG. 22 shows a section taken along the line A–A' in FIG. 21.

Note that a multi electron source having such a structure is manufactured by forming the row- and column-direction wirings 1003 and 1004, the inter-electrode insulating layers (not shown), and the device electrodes and conductive thin films of the surface-conduction emission type electron-emitting devices on the substrate, then supplying electricity to the respective devices via the row- and column-direction wirings 1003 and 1004, thus performing forming processing and activation processing.

FIG. 23 is a block diagram showing an example of a multi-functional display apparatus capable of displaying image information provided from various image information sources such as television broadcasting on the display panel 1 using the surface-conduction emission type electron-emitting device of this embodiment as an electron-beam source.

Referring to FIG. 23, reference numeral 1 denotes the above-mentioned display panel; 2101, a driving circuit for the display panel 1; 2102, a display controller; 2103, a multiplexer; 2104, a decoder; 2105, an I/O interface circuit; 2106, a CPU; 2107, an image generation circuit; 2108, 2109, and 2110, image memory interface circuits; 2111, an image input interface circuit, 2112 and 2113, TV signal reception circuits; and 2114, an input portion. Note that in the display apparatus, upon reception of a signal containing both video information and audio information such as a TV signal, the video information is displayed while the audio information is reproduced. A description of a circuit or speaker for reception, division, reproduction, processing, storage, or the like of the audio information, which is not directly related to the features of the present invention, will be omitted.

The functions of the respective parts will be explained in accordance with the flow of an image signal.

The TV signal reception circuit 2113 receives a TV image signal transmitted using a radio transmission system such as radio waves or spatial optical communication. The scheme of the TV signal to be received is not particularly limited, and is the NTSC scheme, the PAL scheme, the SECAM scheme, or the like. A more preferable signal source to take the advantages of the display panel realizing a large area and a large number of pixels is a TV signal (e.g., a so-called high-quality TV of the MUSE scheme or the like) made up of a larger number of scanning lines than that of the TV signal of the above scheme. The TV signal received by the TV signal reception circuit 2113 is output to the decoder 2104. The TV signal reception circuit 2112 receives a TV image signal transmitted using a wire transmission system such as a coaxial cable or optical fiber. The scheme of the TV signal to be received is not particularly limited, as in the TV signal reception circuit 2113. The TV signal received by the circuit 2112 is also output to the decoder 2104.

The image input interface circuit 2111 receives an image signal supplied from an image input device such as a TV camera or image read scanner, and outputs it to the decoder 2104. The image memory interface circuit 2110 receives an image signal stored in a video tape recorder (to be briefly referred to as a VTR hereinafter), and outputs it to the decoder 2104. The image memory interface circuit 2109 receives an image signal stored in a video disk, and outputs it to the decoder 2104. The image memory interface circuit 2108 receives an image signal from a device storing still image data such as a so-called still image disk, and outputs the received still image data to the decoder 2104.

The I/O interface circuit 2105 connects the display apparatus to an external computer, computer network, or output device such as a printer. The I/O interface circuit 2105 allows inputting/outputting image data, character data, and graphic information, and in some cases inputting/outputting a control signal and numerical data between the CPU 2106 of the display apparatus and an external device.

The image generation circuit 2107 generates display image data on the basis of image data or character/graphic information externally input via the I/O interface circuit 2105, or image data or character/graphic information output from the CPU 2106. This circuit 2107 incorporates circuits necessary to generate images such as a programmable memory for storing image data and character/graphic information, a read-only memory storing image patterns corresponding to character codes, and a processor for performing image processing.

Display image data generated by the circuit 2107 is output to the decoder 2104. In some cases, display image data can also be input/output from/to an external computer network or printer via the I/O interface circuit 2105.

The CPU 2106 mainly performs control of operation of this display apparatus, and operations about generation, selection, and editing of display images. For example, the CPU 2106 outputs a control signal to the multiplexer 2103 to properly select or combine image signals to be displayed on the display panel. At this time, the CPU 2106 generates a control signal to the display panel controller 2102 in accordance with image signals to be displayed, and appropriately controls the operation of the display apparatus in terms of the screen display frequency, the scanning method (e.g., interlaced or non-interlaced scanning), the number of scanning lines for one frame, and the like. The CPU 2106 directly outputs image data or character/graphic information to the image generation circuit 2107. In addition, the CPU 2106 accesses an external computer or memory via the I/O interface circuit 2105 to input image data or character/graphic information.

The CPU 2106 may also be concerned with operations for other purposes. For example, the CPU 2106 can be directly concerned with the function of generating and processing information, like a personal computer or wordprocessor. Alternatively, the CPU 2106 may be connected to an external computer network via the I/O interface circuit 2105 to perform operations such as numerical calculation in cooperation with the external device.

The input portion 2114 allows the user to input an instruction, program, or data to the CPU 2106. As the input portion 2114, various input devices such as a joystick, bar code reader, and speech recognition device are available in addition to a keyboard and mouse.

The decoder 2104 inversely converts various image signals input from the circuits 2107 to 2113 into three primary color signals, or a luminance signal and I and Q signals. As is indicated by the dotted line in FIG. 23, the decoder 2104 desirably incorporates an image memory in order to process a TV signal of the MUSE scheme or the like which requires an image memory in inverse conversion. This image memory advantageously facilitates display of a still image, or image processing and editing such as thinning, interpolation, enlargement, reduction, and synthesis of images in cooperation with the image generation circuit 2107 and CPU 2106. The multiplexer 2103 appropriately selects a display image on the basis of a control signal input from the CPU 2106. More specifically, the multiplexer 2103 selects a desired one of the inversely converted image signals input from the decoder 2104, and outputs the selected image signal to the driving circuit 2101. In this case, the image signals can be selectively switched within a 1-frame display time to display different images in a plurality of areas of one frame, like a so-called multiwindow television.

The display panel controller 2102 controls the operation of the driving circuit 2101 on the basis of a control signal input from the CPU 2106.

As for the basic operation of the display panel, the display panel controller 2102 outputs, e.g., a signal for controlling the operation sequence of a driving power source (not shown) of the display panel to the driving circuit 2101. As for the method of driving the display panel, the display panel controller 2102 outputs, e.g., a signal for controlling the screen display frequency or scanning method (e.g., interlaced or non-interlaced scanning) to the driving circuit 2101.

In some cases, the display panel controller 2102 outputs to the driving circuit 2101 a control signal concerning adjustment of the image quality such as the brightness, contrast, color tone, or sharpness of a display image. The driving circuit 2101 generates a driving signal to be applied to the display panel 1, and operates based on an image signal input from the multiplexer 2103 and a control signal input from the display panel controller 2102.

The functions of the respective parts have been described. The arrangement of the display apparatus shown in FIG. 23 makes it possible to display image information input from various image information sources on the display panel 1. More specifically, various image signals such as television broadcasting image signals are inversely converted by the decoder 2104, appropriately selected by the multiplexer 2103, and supplied to the driving circuit 2101. On the other hand, the display controller 2102 generates a control signal for controlling operation of the driving circuit 2101 in accordance with an image signal to be displayed. The driving circuit 2101 applies a driving signal to the display panel 1 on the basis of the image signal and control signal.

As a result, the image is displayed on the display panel 1. A series of operations are systematically controlled by the CPU 2106.

In the display apparatus, the image memory incorporated in the decoder 2104, the image generation circuit 2107, and the CPU 2106 can cooperate with each other to simply display selected ones of a plurality of pieces of image information and to perform, for the image information to be displayed, image processing such as enlargement, reduction, rotation, movement, edge emphasis, thinning, interpolation, color conversion, and conversion of the aspect ratio of an image, and image editing such as synthesis, erasure, connection, exchange, and pasting. Although not described in this embodiment, an audio circuit for processing and editing audio information may be arranged, similar to the image processing and the image editing.

The display apparatus can therefore function as a display device for television broadcasting, a terminal device for video conferences, an image editing device for processing still and dynamic images, a terminal device for a computer, an office terminal device such as a wordprocessor, a game device, and the like. This display apparatus is useful for industrial and business purposes and can be variously applied.

FIG. 23 merely shows an example of the arrangement of the display apparatus using the display panel having the surface-conduction emission type electron-emitting device as an electron beam source. The present invention is not limited to this, as a matter of course. For example, among the constituents in FIG. 23, a circuit associated with a function unnecessary for the application purpose can be eliminated from the display apparatus. To the contrary, another constituent can be added to the display apparatus in accordance with the application purpose. For example, when the display apparatus is used as a television telephone set, transmission and reception circuits including a television camera, audio microphone, lighting, and modem are preferably added as constituents.

In the display apparatus, since particularly the display panel using the surface-conduction emission type electron-emitting device as an electron beam source can be easily made thin, the width of the whole display apparatus can be decreased. In addition to this, the display panel using the surface-conduction emission type electron-emitting device as an electron beam source is easily increased in screen size and has a high brightness and a wide view angle. This display apparatus can therefore display an impressive image with reality and high visibility.

The present invention may be applied to a system constituted by a plurality of devices (e.g., a host computer, interface device, reader, and printer) or an apparatus comprising a single device (e.g., a copying machine or facsimile apparatus).

The object of the present invention is realized even by supplying a storage medium storing software program codes for realizing the functions of the above-described embodiments to a system or apparatus, and causing the computer (or a CPU or MPU) of the system or apparatus to read out and execute the program codes stored in the storage medium.

In this case, the program codes read out from the storage medium realize the functions of the above-described embodiments by themselves, and the storage medium storing the program codes constitutes the present invention.

As a storage medium for supplying the program codes, a floppy disk, hard disk, optical disk, magneto optical disk, CD-ROM, CD-R, magnetic tape, nonvolatile memory card, ROM, or the like can be used.

The functions of the above-described embodiments are realized not only when the readout program codes are executed by the computer but also when the OS (Operating System) running on the computer performs part or all of actual processing on the basis of the instructions of the program codes.

The functions of the above-described embodiments are also realized when the program codes read out from the storage medium are written in the memory of a function expansion board inserted into the computer or a function expansion unit connected to the computer, and the CPU of the function expansion board or function expansion unit performs part or all of actual processing on the basis of the instructions of the program codes.

As described above, according to the embodiments, the color tone of a display image and the like can be adjusted for each color by adjusting a voltage applied to the fluorescent substance of each color.

According to the present invention, the color of a display image can be adjusted with a simple hardware arrangement.

As has been described above, according to the present invention, color adjustment can be achieved by controlling the electron-emitting amount from electron-emitting devices which drive emission substances of respective colors.

According to the present invention, voltage sources are adopted in correspondence with driving sources for emission substances of respective colors. The output voltage of each voltage source can be controlled to control the electron-emitting amount for driving the emission substances, thereby achieving color adjustment.

According to the present invention, current sources are adopted in correspondence with driving sources for emission substances of respective colors. The output current of each current source can be controlled to control the electron-emitting amount for driving the emission substances, thereby achieving color adjustment.

According to the present invention, emission substances of respective colors are laid out in stripes. Charges applied to emission substances of the respective colors can be adjusted in accordance with designated color adjustment, thereby adjusting display colors.

As many apparently widely different embodiments of the present invention can be made without departing from the spirit and scope thereof, it is to be understood that the invention is not limited to the specific embodiments thereof except as defined in the appended claims.

What is claimed is:

1. An image display apparatus comprising:

an electron source having a plurality of electron-emitting devices arranged in a matrix form;

a plurality of column direction wirings each of which is connected to electron-emitting devices arranged in each column of said plurality of electron-emitting devices;

emission means, having emission substances corresponding to respective colors, for emitting light upon reception of electrons emitted by said electron source, thereby displaying a color image;

modulation means for outputting a pulse signal having a modulated pulse width corresponding to an image signal; and a plurality of voltage control means each of which is assigned to a different color to change a voltage of the pulse signal for driving each of the electron-emitting devices for irradiating the emission substances corresponding to its assigned color with electrons, wherein each of said plurality of voltage control means is provided commonly to said plurality of column direction wirings in its assigned color unit and is capable of changing the voltage of the pulse signal for its assigned color independently to adjust that color, and wherein the pulse signal corresponding to each color is applied to each of said plurality of column direction wirings.

2. An image display apparatus comprising:

an electron source having a plurality of electron-emitting devices arranged in a matrix form;

a plurality of column direction wirings each of which is connected to electron-emitting devices arranged in each column of said plurality of electron-emitting devices;

emission means, having emission substances corresponding to respective colors, for emitting light upon reception of electrons emitted by said electron source, thereby displaying a color image;

modulation means for outputting a pulse signal having a pulse width corresponding to an image signal;

a plurality of current control means each of which is assigned to a color to change a current of the pulse signal for driving each of the electron-emitting devices for irradiating the emission substances corresponding to its assigned color with electrons; and voltage sources for controlling said plurality of current control means respectively provided commonly to said plurality of column direction wirings in its associated color unit, wherein each of said plurality of current control means is capable of changing the current of the pulse signal for its assigned color independently to adjust that color, and wherein the pulse signal corresponding to each color is applied to each of said plurality of column direction wirings.

3. The apparatus according to claim 1 further comprising instruction means for instructing adjustment of a display color, and said voltage control means controls the voltage of the pulse signal in accordance with an instruction from said instruction means.

4. The apparatus according to claim 1, wherein said plurality of electron-emitting devices are laid out in a matrix, and said emission substances corresponding to the respective colors are laid out in stripes in units of colors.

5. The apparatus according to claim 4, further comprising scanning driving means for selecting respective scanning lines of said plurality of electron-emitting devices, and applying a predetermined voltage to the selected scanning lines.

6. The apparatus according to claim 4, wherein the pulse signal output from said modulation means is input to a column wiring of the matrix.

7. The apparatus according to claim 1, wherein said emission substances corresponding to the respective colors are R, G, and B fluorescent substances.

8. The apparatus according to claim 1, wherein said electron-emitting device is a cold cathode device.

9. The apparatus according to claim 8, wherein said electron-emitting device is an FE type electron-emitting device.

10. The apparatus according to claim 8, wherein said electron-emitting device is an MIM type electron-emitting device.

11. The apparatus according to claim 1, wherein said electron-emitting device is a surface-conduction emission type electron-emitting device.

12. A display control method in an image display apparatus having an electron source with a plurality of electron-emitting devices arranged in a matrix form, emission substances corresponding to respective colors, a plurality of column direction wirings each of which is connected to electron-emitting devices arranged in each column of said plurality of electron-emitting devices and emission means for emitting light upon reception of electrons emitted by the electron source to display a color image, comprising:

a modulation step of outputting a pulse signal having a modulated pulse width corresponding to an image signal; and a voltage control step of changing a voltage of the pulse signal for driving each of the electron-emitting devices for irradiating the emission substances corresponding to the respective colors with electrons, wherein said voltage control step changes a voltage of the pulse signal by a plurality of voltage control means provided commonly to the plurality of column direction wirings in its assigned color unit, wherein the voltage of the pulse signal is changeable independently for each color to adjust color displayed in said voltage control step, and wherein the pulse signal corresponding to each color is applied to each of the plurality of column direction wirings.

13. The method according to claim 12, wherein the method further comprises the instruction step of instructing adjustment of a display color, and the voltage control step comprises controlling the voltage of the pulse signal in accordance with an instruction in the instruction step.

14. A display control method in an image display apparatus having an electron source with a plurality of electron-emitting devices arranged in a matrix form, emission substances corresponding to respective colors, a plurality of column direction wirings each of which is connected to electron-emitting devices arranged in each column of said plurality of electron-emitting devices, and emission means for emitting light upon reception of electrons emitted by the electron source to display a color image, comprising:

a modulation step of outputting a pulse signal having a pulse width corresponding to an image signal; and a current control step of changing a current of the pulse signal for driving each of the electron-emitting devices for irradiating the emission substances corresponding to the respective colors with electrons, wherein said current control step changes a current of the pulse signal by a plurality of voltage sources provided commonly to the plurality of column direction wirings in its assigned color unit, wherein the current of the pulse signal is changeable independently for each color to adjust color displayed in said current control step, and wherein the pulse signal corresponding to each color is applied to each of the plurality of column direction wirings.

15. An image display apparatus comprising:

a display panel in which devices are arranged at or near intersections of modulated-signal wirings and scanning wirings, and devices connected to a common modulated-signal wiring emit light of the same color;

a control voltage source for supplying an adjustable control voltage corresponding to each color of light emitted by said display panel;

a variable current source which is connected to the modulated-signal wiring, receives from said control voltage source a control voltage corresponding to a color of light emitted by devices connected to the modulated-signal wiring, and outputs a current corresponding to the control voltage to the modulated-signal wiring; and a modulated-signal driver for modulating the current output from said variable current source into a pulse having a width corresponding to an image signal value.

16. The apparatus according to claim 15, wherein said control voltage source includes a first voltage source for outputting a first voltage adjustable by an operator and a second voltage source for outputting a second voltage corresponding to correction data for correcting an input/output characteristic of each device, and outputs a voltage adjusted by the second voltage based on the first voltage.

17. The apparatus according to claim 15, wherein said display panel has elementary colors laid out in stripes in units of modulated-signal wirings, and said control voltage source is independent for each elementary color.

18. The apparatus according to claim 15, wherein said display panel comprises a fluorescent plate of colors corresponding to the respective devices, and emits light upon collision with an electron beam emitted by the device.

19. The apparatus according to claim 15, wherein the device is a cold cathode device.

20. The apparatus according to claim 19, wherein the cold cathode device is a surface-conduction emission type electron-emitting device.

21. The apparatus according to claim 19, wherein the cold cathode device is a field emission type electron-emitting device.

22. The apparatus according to claim 15, wherein the device is an electroluminescent device.

23. A display control method in an image display apparatus in which devices are arranged at or near intersections of modulated-signal wirings and scanning wirings, and devices connected to a common modulated-signal wiring emit light of the same color, comprising:

the voltage control step of supplying an adjustable control voltage corresponding to each color of light emitted by a display panel;

the variable current output step of receiving a control voltage corresponding to a color of light emitted by devices connected to the modulated-signal wiring, and outputting a current corresponding to the control voltage to the modulated-signal wiring; and the modulation step of modulating the current output from a variable current source into a pulse having a width corresponding to an image signal value.

24. The method according to claim 23, wherein the voltage control step comprises using a first voltage source for outputting a first voltage adjustable by an operator and a second voltage source for outputting a second voltage corresponding to correction data for correcting an input/output characteristic of each device, and outputting a voltage adjusted by the second voltage based on the first voltage.

25. The method according to claim 23, wherein devices which emit light of the same color are laid out in a stripe, and a control voltage source is independent for each elementary color.

26. The method according to claim 23, wherein light is emitted by causing an electron beam emitted by the device to collide against a fluorescent plate of colors corresponding to the respective devices.

27. The method according to claim 23, wherein the device is a cold cathode device.

28. The method according to claim 27, wherein the cold cathode device is a surface-conduction emission type electron-emitting device.

29. The method according to claim 28, wherein the cold cathode device is a field emission type electron-emitting device.

30. The method according to claim 23, wherein the device is an electroluminescent device.

31. An image display apparatus comprising:

a display panel having devices, modulated-signal wirings and scanning wirings, said devices being connected to a common modulated signal wiring emit light of the same color;

a plurality of control voltage sources each of which is assigned to a color to supply adjustable control voltage corresponding to each color of light emitted by said display panel and is capable of adjusting its assigned color independently; and a modulated-signal driver which is connected to said modulated-signal wiring, receives from said control voltage source a control voltage corresponding to a color of light emitted by devices connected to the modulated-signal wiring, and outputs the control voltage to the modulated-signal wiring, wherein said modulated-signal driver modulates the control voltage from said control voltage source into a modulated voltage pulse having a width corresponding to an image signal value, and wherein each of said plurality of voltage control sources is provided commonly to said modulated signal wirings in its assigned color unit.

* * * * *

UNITED STATES PATENT AND TRADEMARK OFFICE

CERTIFICATE OF CORRECTION

PATENT NO. : 6,552,702 B1
DATED : April 22, 2003
INVENTOR(S) : Naoto Abe et al.

It is certified that error appears in the above-identified patent and that said Letters Patent is hereby corrected as shown below:

Column 10,
Line 14, “For:” should read -- For --.
Line 20, “(PCLK)” should read -- (PCLK). --.

Signed and Sealed this

Second Day of December, 2003

JAMES E. ROGAN
*Director of the United States Patent and Trademark Office*